US007559990B2

(12) United States Patent
Pankake

(10) Patent No.: US 7,559,990 B2
(45) **Date of Patent: *Jul. 14, 2009**

(54) COATING APPARATUS AND METHOD

(76) Inventor: Eugene A Pankake, 2499 Fuquay Rd., Newburgh, IN (US) 47630

( * ) Notice: Subject to any disclaimer, the term of this patent is extended or adjusted under 35 U.S.C. 154(b) by 552 days.

This patent is subject to a terminal disclaimer.

(21) Appl. No.: 10/711,927

(22) Filed: Oct. 13, 2004

(65) Prior Publication Data

US 2005/0034659 A1 Feb. 17, 2005

Related U.S. Application Data

(63) Continuation-in-part of application No. 10/707,278, filed on Dec. 2, 2003, now Pat. No. 6,837,932, which is a continuation of application No. 09/678,228, filed on Oct. 2, 2000, now Pat. No. 6,656,529, which is a continuation of application No. PCT/US99/10819, filed on May 18, 1999.

(60) Provisional application No. 60/617,363, filed on Oct. 8, 2004, provisional application No. 60/547,336, filed on Feb. 24, 2004, provisional application No. 60/527,894, filed on Dec. 8, 2003, provisional application No. 60/520,151, filed on Nov. 14, 2003, provisional application No. 60/511,146, filed on Oct. 14, 2003, provisional application No. 60/086,047, filed on May 19, 1998.

(51) Int. Cl.
*B05B 3/02* (2006.01)

(52) U.S. Cl. ..... 118/413; 118/602; 118/261

(58) Field of Classification Search ..... 118/413, 118/302, 602, 261, 419, 323, 325, 244, 258, 118/259; 134/166 R; 427/356, 428.19
See application file for complete search history.

(56) References Cited

U.S. PATENT DOCUMENTS

| | | | |
|---|---|---|---|
| 2,761,419 | A | 9/1956 | Mercier et al. |
| 3,079,889 | A | 3/1963 | Jacobs et al. |
| 3,131,092 | A | 4/1964 | Coghill |
| 3,192,895 | A | 7/1965 | Galer |
| 3,301,214 | A | 1/1967 | Coghill |

(Continued)

FOREIGN PATENT DOCUMENTS

| | | |
|---|---|---|
| DE | 42 41 792 | 6/1994 |
| GB | 1 322 861 | 7/1973 |

*Primary Examiner*—Brenda A Lamb
(74) *Attorney, Agent, or Firm*—Oppedahl Patent Law Firm LLC

(57) ABSTRACT

Two embodiments of end seal design are described, each having preferably three seal lips, one of which differs in the center of its radius of curvature from the center of radius of curvature for the other two seal lips. The end seal is gently spring loaded. In this way the end seal provides a good seal and minimizes spray, spatter, and slinging, and can accommodate various plunge depths and can accommodate various angles of attack of a nozzle upon an application surface such as a web or applicator roll. The nozzle is able to have any of various user-determined angles of attack upon the application surface.

17 Claims, 20 Drawing Sheets

U.S. PATENT DOCUMENTS 3,486,482 A * 12/1969 Hunger ..... 118/603
3,526,528 A 9/1970 Takahashi et al.
3,884,611 A 5/1975 Anderson et al.
3,940,221 A 2/1976 Nissel
4,102,299 A * 7/1978 Wallsten ..... 118/50
4,142,010 A 2/1979 Pipkin et al.
4,257,343 A 3/1981 Kullander
4,327,662 A 5/1982 Damrau
4,332,543 A 6/1982 Fulton et al.
4,351,264 A 9/1982 Flaum et al.
4,385,960 A 5/1983 Zodrow et al.
4,405,661 A * 9/1983 Alheid ..... 427/356
4,459,831 A * 7/1984 Grandi ..... 68/18 R
4,480,583 A 11/1984 Tanaka et al.
4,480,898 A 11/1984 Taylor
4,836,133 A 6/1989 Wohrle
4,839,201 A 6/1989 Rantanen et al.
4,869,933 A * 9/1989 Sollinger et al. ..... 427/356
5,033,403 A 7/1991 Mladota
5,099,786 A 3/1992 Shibata et al.
5,136,972 A 8/1992 Naka et al.
5,208,078 A 5/1993 Ishibashi et al.
5,234,500 A 8/1993 Korokeyi
5,318,804 A 6/1994 Yoshida
5,320,679 A 6/1994 Derezinski et al.
5,329,964 A 7/1994 Derezinski
5,395,653 A 3/1995 Baum
5,411,589 A 5/1995 Yoshida et al.
5,435,847 A 7/1995 Shibata et al.
5,484,482 A 1/1996 Rantanen et al.
5,497,702 A 3/1996 Gorter
5,516,557 A * 5/1996 Willnow et al. ..... 427/358
5,674,319 A 10/1997 Slobodkin
5,720,812 A * 2/1998 Madrzak et al. ..... 118/126
5,743,964 A 4/1998 Pankake
5,807,434 A 9/1998 Innes
6,004,394 A 12/1999 Gottwald
6,106,900 A 8/2000 Innes et al.

* cited by examiner

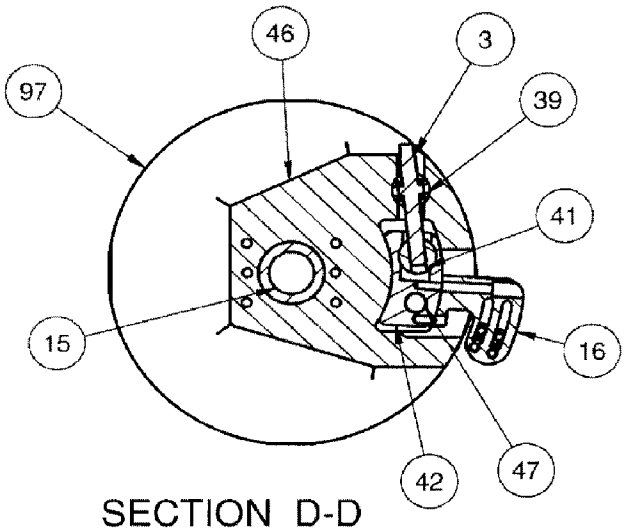
SECTION D-D
FIG. 4
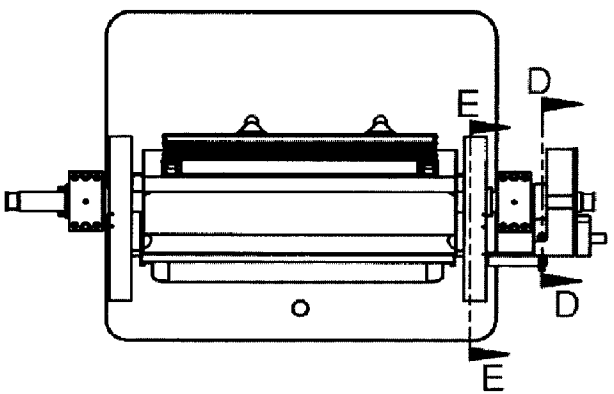
FIG. 5
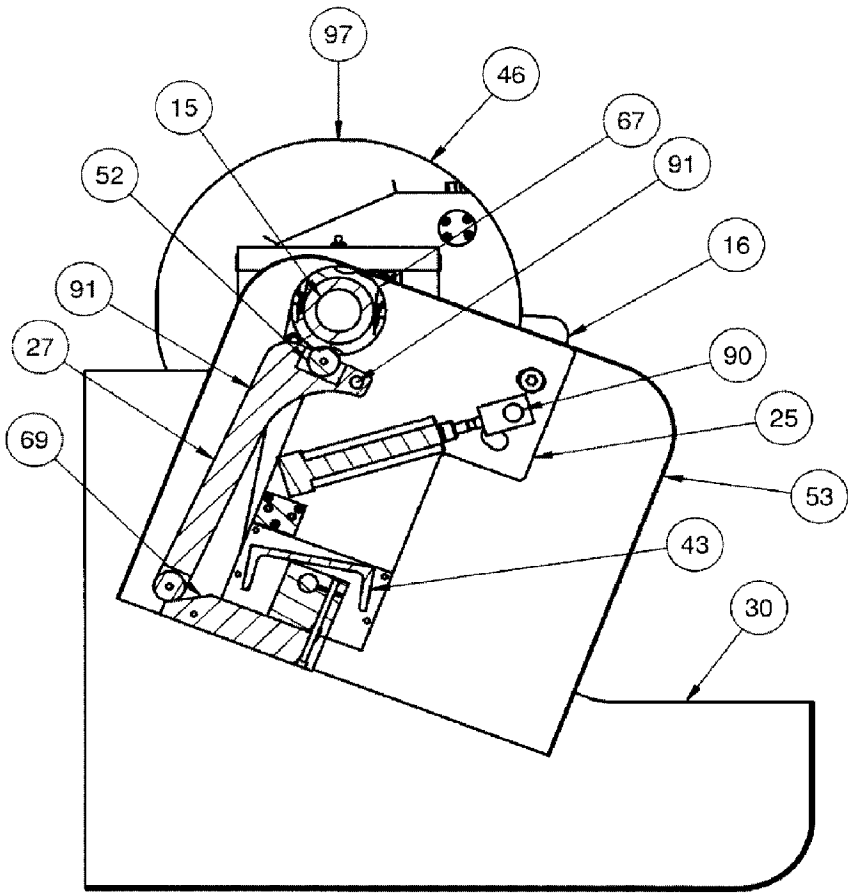
SECTION E-E

SECTION N-N

DETAIL P

6

112
6
55
7
56
DETAIL P
SECTION O-O
34
O
O 57
109
108

55
114
6
31
34
7
56
34
57
109
108
DETAIL S

S
77
SECTION R-R
R
R

DETAIL U
SECTION T-T
T
T
114
112
6
111
7
31
34
56
34
57
55
109
108
6
77

SECTION V-V

COATING APPARATUS AND METHOD

CROSS-REFERENCE TO RELATED APPLICATIONS

This application claims priority from U.S. application No. 60/511,146 filed Oct. 14, 2003, U.S. application No. 60/520,151 filed Nov. 14, 2003, U.S. application No. 60/527,894 filed Dec. 8, 2003, U.S. application No. 60/547,336 filed Feb. 24, 2004, and U.S. application No. 60/617,363, filed Oct. 8, 2004, each of which is hereby incorporated herein by reference for all purposes. This application is a continuation-in-part of U.S. application Ser. No. 10/707,278 filed Dec. 2, 2003, now U.S. Pat. No. 6,837,932 which is a continuation of U.S. application Ser. No. 09/678,228 Oct. 2, 2000, now U.S. Pat. No. 6,656,529 issued Dec. 2, 2003, which is a continuation of U.S. application No. PCT/US99/10819 filed May 18, 1999, which claims priority from U.S. application No. 60/086,047 filed on May 19, 1998, each of which is hereby incorporated herein by reference for all purposes.

BACKGROUND OF THE INVENTION

The invention relates generally to the application of coatings to webs, for example the application of paint to metal roll stock. If paint (or some other coating) is to be applied to metal roll stock, a typical way to do this is by means of a production line that starts at one end with metal roll stock that is desired to be coated, continues to a coater which applies the paint, proceeds to a drying or curing area, and ends with metal roll stock that has been coated. Such production lines are well known.

Prior-art coating production lines, however, have had many problems. One problem is that it is all too easy to apply a coating that is too thin or too thick. If the coating is thicker than necessary, money is wasted because too much coating gets used. Another problem is that with many coaters, there can be unevenness in the coating, with puckering, gapping, voids, and the like. Still another problem is that with many coaters, there are wear items that wear out quickly. When a wear item wears out, this forces the production line to be shut down. Finally, the need to make a change in the coating fluid (e.g. a change in paint color) may also require shutting down the production line.

As set forth in parent U.S. Pat. No. 6,656,529, a coater may employ a nozzle. The nozzle is elongated and is oriented with its elongated dimension perpendicular to the direction of motion of the web that is being coated. Coating (for example paint) is present in the nozzle and is able to flow out the nozzle toward the web. The nozzle will thus define a leading edge (which the web or applicator roll encounters first along its direction of travel) and a trailing edge (which the web or applicator roll encounters later along its direction of travel). The leading edge, the trailing edge, and the web or roll itself help to define where the paint goes and where it does not go. Clever selection of geometry and materials in the leading and trailing edges, as discussed in parent U.S. Pat. No. 6,656,529, permit the nozzle to serve its purpose effectively.

A moment's reflection will prompt a realization that even with ideally selected materials and geometry for the leading and trailing edges of the nozzle, a nontrivial design problem remains. How are the ends of the nozzle to be designed? One end will be at or near one edge of the web that is to be coated, while the other end will be at or near the other edge of the web that is to be coated. If little or no thought is given to the designs of the two ends of the elongated nozzle, then coating (e.g. paint) is likely to leak out the ends, and indeed may spray out depending on the pressure in the nozzle.

In the case where a transfer roll is used to transfer coating from the nozzle to the web, any excessive amount of coating leaking out the ends is likely to "sling" out due to centrifugal force, traveling in uncontrolled directions. On the other hand if the nozzle is applying coating directly to a web, then any leaking excess coating will lead to unevenness and possibly excess material along the edges of the web.

Enormous amounts of time and energy have been devoted by many investigators to attempt to address the problem of what to do with ends of such applicator nozzles. One approach is to try to devise "end seals," one at each end of the nozzle, which are intended to seal to the web or applicator roll, so as to block leakage out the ends of the nozzle. Unfortunately, many end seal designs that have been proposed have not served their purpose well. Some end seal designs are wear items, wearing out often and requiring replacement. Other end seal designs will "plunge" into the flexible surface of an applicator roll and will cause the applicator roll to wear and to lose surface material due to the wear. Still other end seal designs are extremely sensitive to even the smallest changes in spacing and geometry as between the nozzle and the web or applicator roll; with some end seal designs even a small change can lead to excessive wear on the one hand or excessive leakage on the other hand.

There is thus a great need for end seal designs that do not wear out too fast, that do not damage an applicator roll, and that are not unduly sensitive to changes in spacing and geometry as between the nozzle and the web or applicator roll surface. It has proven to be important to develop end seals that permit deep plunge into the application surface without overloading the end seal or damaging the application surface.

Yet another problem in the design of coaters is that it is desired to have close control over the manner in which the nozzle applies the coating to the surface being coated (e.g. the web or applicator roll). In past designs it is commonplace to try to achieve this control by moving the nozzle closer to or further from the surface being coated. Close control of such a distance is not easy, because of manufacturing tolerances, wear and expansion of transfer rollers, and other factors. Even if one is able to control such a distance closely, this does not control, as closely as one might wish, the manner in which the coating is applied to the surface being coated.

There is thus a great need for a coater design that permits more subtle control over the manner in which the nozzle applies the coating to the surface being coated. Such a design needs to work well with whatever end-seal design is to be employed.

SUMMARY OF THE INVENTION

Two embodiments of end seal design are described, each having preferably three seal lips, one of which differs in the center of its radius of curvature from the center of radius of curvature for the other two seal lips. The end seal is gently spring loaded. In this way the end seal provides a good seal and minimizes spray, spatter, and slinging, and can accommodate various plunge depths and can accommodate various angles of attack of a nozzle upon an application surface such as a web or applicator roll. The nozzle is able to have any of various user-determined angles of attack upon the application surface.

As will be discussed below, importantly the end seal is able to accommodate large angle changes, in excess of six degrees, and is able to permit a large range of direct plunge depths (approximately 0.03" to 0.2") relative to the nozzle into the application surface. In the case where a rigid application surface (chrome, steel, ceramic, etc applicator roll, steel roll backing up the sheet when direct application to the sheet occurs) is employed, the nozzle and end seal are able to accommodate 100% of the plunge within the nozzle. Alternatively, if a deformable application surface is used, then angle changes and plunge can be nearly all accomplished through deformation of the application surface. A 40 durometer polyurethane application surface would permit a high deformation into its surface.

The end seals according to the invention are quite different from prior-art end seals. The end seals according to the invention are designed to permit ideal (or adequately close to ideal) geometry and force to be maintained between the end seal and the application surface for a very wide range of roll surface finishes, roll hardness and pressure feed application system bar angles using both a rigid pressure feed application system nozzle or a flexible nozzle. This is done by permitting the end seal surface contacting the application surface and the application surface to be concentric within a wide range of nozzle contact angles. In addition the end seal force to the application surface is controlled to a nearly constant value through a plunge into the application surface or nozzle deformation of approximately 0.03" to 0.20". This capability permits the contact angle of the nozzle to the application surface to vary through an approximate 10-degree range and permits nip forces to vary greatly with simple and manual coater control actuators (e.g. metering roll position actuators) or fully automated actuators.

In addition to the straightforward effects of nip pressure on metering the coating film thickness, the deformation of the flexible nozzle creates another powerful dependent actuator. This actuator is the deformation of the nozzle creating different geometry at the nip point very much like changing the diameter of the roll. In conventional coating it is common to set up the process with specific roll diameters to achieve specific goals. If a different coating with different requirements is applied it may be necessary to change one or more of the roll diameter, the surface finish or the roll cover thickness and/or roll cover hardness. The ability to change the nozzle angle and plunge significantly and on the fly permits a more powerful tool for film thickness control without the need to stop the production process. A typical roll coating process will have roll plunge values of 0.010" to 0.035". It is very rare that a process is outside of this range. The greater the plunge distance, the less inherent variability from roll swell, roll runout, roll bearing runout, cover hardness variability, and roll cover thickness variability that is translated to coating film thickness variability. The pressure feed application system coating technology with the end seals according to the invention can permit 0.170" plunge or greater. This results in a reduction in film thickness variability to many times less than can be achieved with any type of conventional roll coating. The typical variability for roll and bearings can easily be 0.002". If the total deformation during the roll coating process is 0.020" with roll variability of 0.004" (for two rolls) product variability will be much greater than a coating process with roll variability of 0.001" (for one roll) with a 0.170" total deformation targeting the same nominal film thickness.

This translates to savings in several ways. First, it is necessary for any company that applies coating to substrates to ensure that the film thickness is no less than the lowest acceptable film thickness. It is necessary to do this regardless of whether the material is siding, roofing, fin stock, food containers, appliance or automobile body stock. Any observed variability in film thickness requires increasing the amount of coating that must be applied, so as to protect this bottom end, namely, to ensure that the film thickness is no less than the lowest acceptable film thickness. Variability of plus or minus 5% with a normal distribution in the nominal thickness requires a cushion which is typically 5%. In addition, the variability above the lowest thickness in a coil is unnecessary material applied. Thus 5% of the material applied is applied unnecessarily, just to protect the bottom specification, that is, to ensure that the film thickness is no less than the lowest acceptable film thickness.

During start-up of a new product using conventional roll coating it is very difficult to set up the coating thickness accurately. This normally requires setting up, running a sample and measuring its thickness, then tweaking into the desired value. The material used in the run for this set-up is scrap as it cannot be used for anything. Very accurate start-up film thickness on conventional coil coaters requires sophisticated controls that are very seldom seen on roll coaters.

For a given applicator roll, its first few hours in service are hours in which the roll will frequently be seen to swell and to soften. During this time the applied film thickness is increasing. The operator is required to monitor and make adjustments based on the next end of coil film thickness, or a closed-loop film thickness control system is required to make corrections. The flexible nozzle design according to the invention permits the use of a very hard polymer covering (that is, a covering that does not swell or swells very little), or permits the use of a non-flexible applicator roll such as a chrome roll. A combination of elimination of at least one set of roll variability, the large increase in deformation capability, the ability to use rolls that do not change shape or hardness, and the ability to control nip shape geometry, provides the ability to precisely control film thickness from beginning to end of a coil at levels of precision not conceivable with conventional roll coating. The flexible nozzle can permit effective nip geometries from approximately the equivalent of a 20-inch to less than a 4-inch diameter metering roll. This provides an enormous range for film thickness control.

This large range of angle adjustment does create other problems with the pressure feed application system that must be addressed. The total angle control range for the technology in parent U.S. Pat. No. 6,656,529 is approximately 1 degree with a plunge of approximately 0.040". A fixed location for the return funnels is acceptable with these limited movements, but the larger pressure feed application system bar movements permitted with the new end seals and the flexible nozzle create problems. The return funnels cannot be positioned in one location and accommodate this motion. The return funnel that simply slides in and out with the pressure feed application system bar will no longer close to the necessary location when the nozzle is positioned at a high angle relative to the application surface.

Disclosed herein is equipment that insures the proper geometry of the return funnels to the return troughs and the cleaning shell to the rigid frame/nozzle. Both the return funnels and the cleaning shell equipment are rotated into the correct production orientation with the locking device, yet the return funnels and the cleaning shell are free to open away from the pressure feed application system bar to facilitate 180-degree rotation of the pressure feed application system bar. If the pressure feed application system bar operating angle changes relative to the application surface, the return funnels and cleaning shell follow this angle change so as to always be properly oriented. There are many mechanical systems that can accomplish this. Actuators can be mechanically, pneumatically, hydraulically or electro-mechanically driven. The key to successful implementation is that the return funnels and cleaning shell follow the pressure feed application system bar position and angle.

DESCRIPTION OF THE DRAWING

FIG. 4 is a broken-away view though the angle adjustment pin 3 in the locking device 97. FIG. 5 is a broken-away view though the return funnel and return funnel actuators looking toward the locking device 97 of the pressure feed application system coater.

FIG. 30 is an end seal side view with seal position at minimal deflection and angle neutral, while FIG. 32 is an end seal side view with seal position at full deflection and angled up, while

FIG. 35 is an end seal side view with seal position at minimal deflection and angled up, while FIG. 37 is an end seal side view with seal position at full deflection and angled down, while

DETAILED DESCRIPTION

Figures 1, 1A:
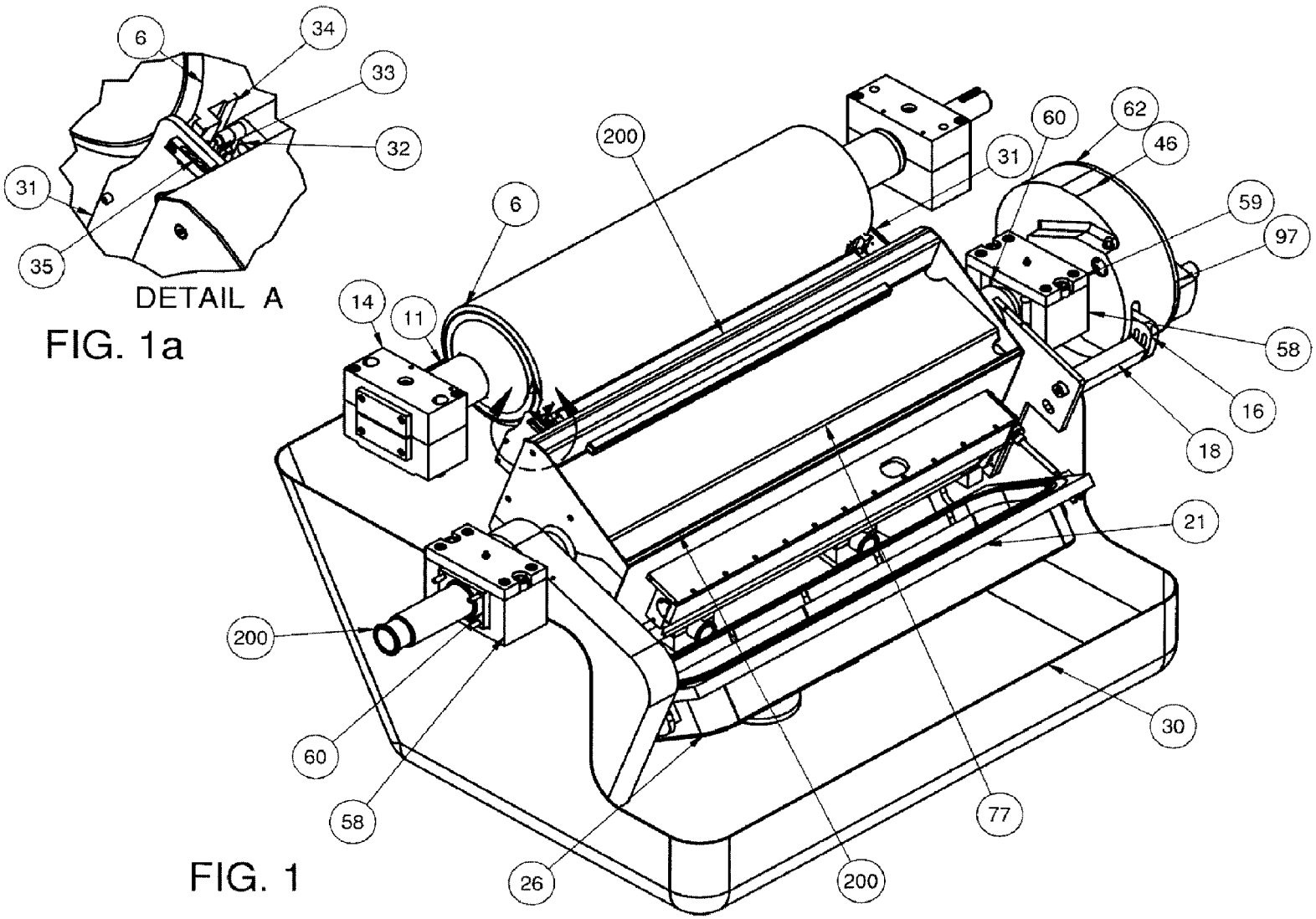
FIG. 1 is a perspective view of the pressure feed application system coater configured to bolt to a conventional two-roll coater with return funnel open.
FIG. 1*a* is a detail perspective view of one of the end seal/nozzle locations on the pressure feed application system coater configured to bolt to a conventional two-roll coater. In these FIGS. 1 and 1*a*, the roll 6 rotates counter-clockwise.

FIGS. 1-17 show a preferred embodiment of a system 100 for coating a web of material made in accordance with the present invention. The system 100 includes a roll 6 for application of coating or for backing up the web of material that the coating is being applied hereto. The roll is supported by a frame that may be fixed or movable and is well understood by anyone familiar in the art of coil coating. When application of coating to an applicator roll 6 for transfer to the web, the roll shown would be mounted on applicator roll traverse slides (not shown). The pressure feed application system assembly 200 is supported by pressure feed application system traverse slides similar to the metering roll traverse slides on a typical two-roll coater. FIG. 1 illustrates the pressure feed application system equipment required to convert a conventional two- or three-roll coater to a pressure feed application system coater. It is shown configured to mount on any one of many manual coater machines. Conversion of a manual coater to a fully automated machine, when undertaken according to the invention, is straightforward. It can be done by converting the manual adjustments to electromechanical adjustments.

The majority of roll coaters in service around the world today are manual machines. The pressure feed application system technology disclosed herein permits direct implementation with any present-day manual coater to improve the process, making it very precise and much more efficient. The pressure feed application system bar can be mounted on existing applicator, metering or pick-up roll bearing supports depending on the desired process.

While FIG. 1 illustrates using an applicator roll, the teachings of the invention may also be used with the roll shown as a back-up roll for direct application to the web. In such an arrangement the web passes between the pressure feed application system bar and the roll. The pressure feed application system bar shown in these figures is illustrated with a flexible nozzle 55, FIG. 2*a*. The basic features for this application involve optimization of pressure feed application system technology for general service and for use with the flexible nozzle.

Figure 23:
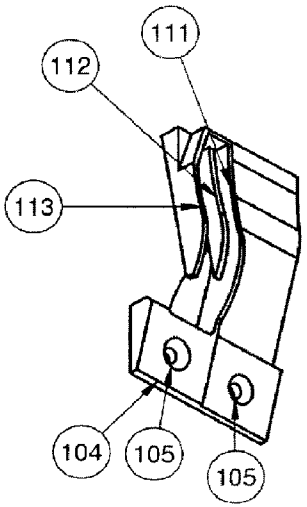
FIG. 23 is a perspective view of the end seal flexible top.
Figure 22:
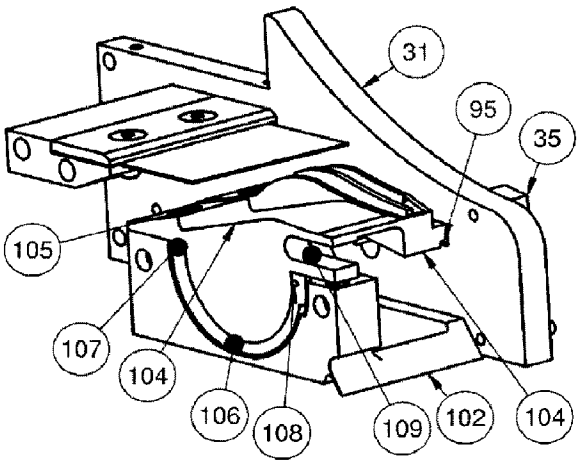
FIG. 22 is a perspective view of the end seal.

The pressure feed application system 200 illustrated in FIG. 1 is based on the coating delivery and application system in parent U.S. Pat. No. 6,656,529 with enhancements according to the present invention. This unit is supported by outboard bearing housings 58 that are supported on movable slides. These arms are moved either automatically or manually and are well understood by anyone familiar in the art of coating application. FIGS. 1, 1*a*, 2, 2*a*, 3 and 5 are views and cross sections that show the enhancements according to the invention as part of the total assembly. The locking device 97 in these views is mounted on one or both center shafts 15 at the end of the pressure feed application system assembly. These center shafts 15 in turn are rigidly mounted to the rigid frame 77. The purpose of the locking device 97 is to control the angular position of the rigid frame 77, the return funnel assembly 27 and the cleaning shell assembly 26. The details for the locking device 97 are shown in FIGS. 4, 6, 7, and 8, discussed below. The cleaning shell assembly 26 and return funnel assembly, 27 are mounted on the center shafts 15 through the cross-connection frame 43, and are rotationally locked by the locking device 97. The detail illustration of the cleaning shell assembly 26 is shown in FIGS. 9, 10, 11, 12, and 13, discussed below. The detail illustration of the return funnel assembly 27 is shown in FIGS. 9, 14, 15, 16, and 17, discussed below. The end seal 120 and end seal 130 each represent an approach for improved sealing of the ends of the nozzle cavity. The end seal 120 is illustrated in FIGS. 17*a*, 18, 19, 20, 25, 30, 31, 32, 33, 34, 35, 36, 37, 38, 39 and 40, discussed below. The end seal 130 is illustrated in FIGS. 21, 22 and 23.

Before commencing a detailed description of embodiments of the invention, it is helpful to review some of the main parts of a coating system. Turning to FIG. 1, a web (omitted for clarity) may pass upwards between roll 6 and nozzle 55. Alternatively, the nozzle 55 may apply coating to roll 6, which in turn passes the coating to a web (omitted for clarity) or to a second roll (omitted for clarity) which in turn passes the coating to a web.

As described in parent U.S. Pat. No. 6,656,529, it is preferable to have a bar 200 with two nozzles 55 (both shown in FIG. 1). The bar is first in the position shown in FIG. 1 and coating is applied to the web or roll. At a later time it is desired to switch to the other nozzle 55. To bring about this result, the bar is rotated 180 degrees, bringing the other nozzle 55 nearby to the web or roll. Cleaning shell 21 is rotated upwards and into close proximity to the offline nozzle 55. Solvent is sprayed onto the offline nozzle to clean it. In this way, as described in parent U.S. Pat. No. 6,656,529, the nozzle 55 can be changed without the need of shutting down the production line. As will be described later, locking and angle adjustment is accomplished with a device 97 shown in FIG. 1.

Figures 2, 2A:
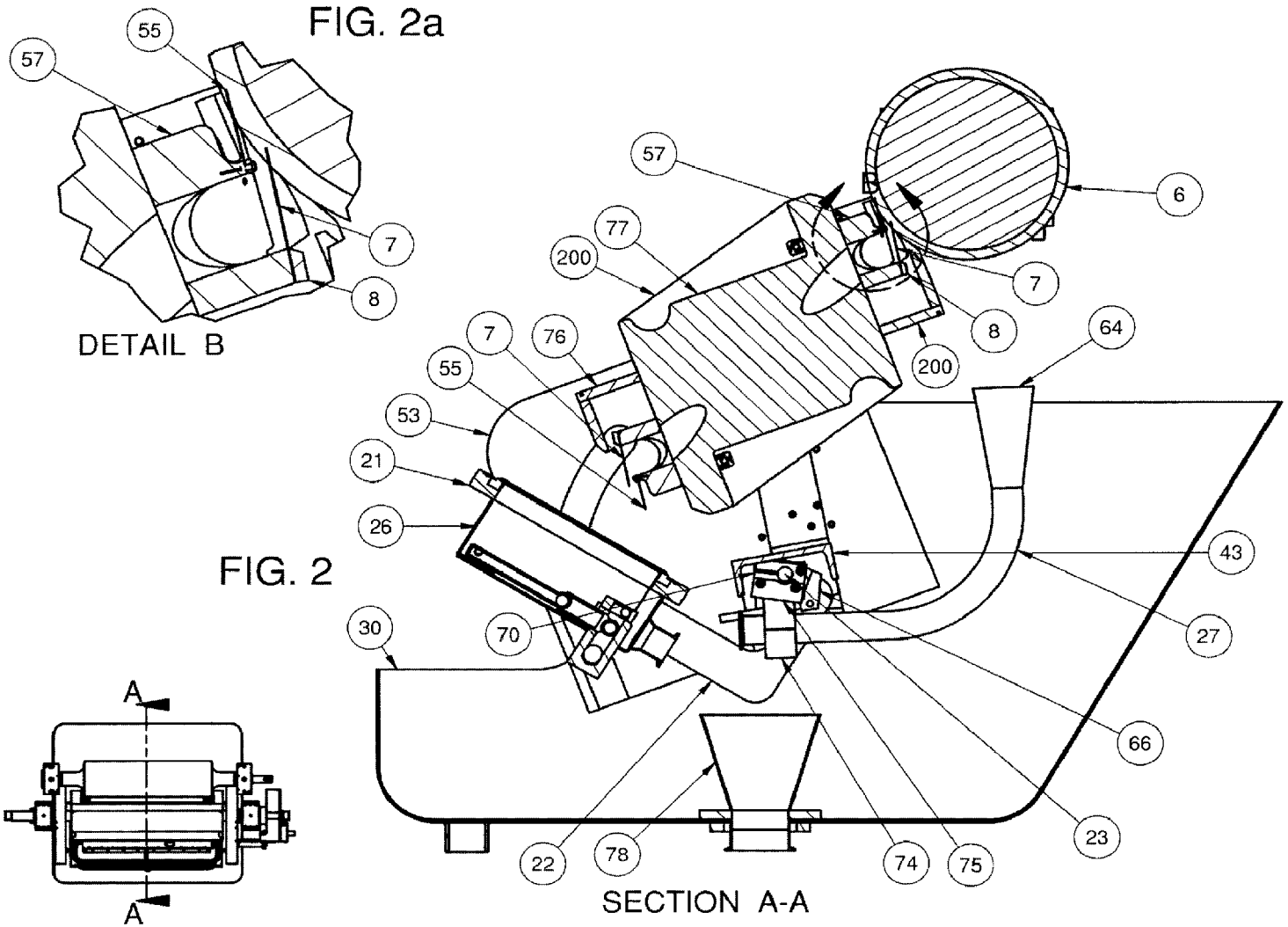
FIG. 2 is a broken-away view though the center of the pressure feed application system coater with return funnel 64 and cleaning shell 21 open.
FIG. 2*a* is a broken-away detail view at the nozzle though the center of the pressure feed application system coater. In these FIGS. 2 and 2*a*, the roll 6 rotates clockwise.

Turning to FIG. 2, we can see an axial view of the roll 6 and the bar or frame 77. Roll 6 rotates clockwise in FIG. 2. Nozzle 55 that is nearby to roll 6 (toward the upper right side of FIG. 2) applies coating to the roll. Offline nozzle 55 (toward the lower left in FIG. 2) permits identification of back seal 7 and an edge of the nozzle 55. Back seal 7 is the "leading edge" mentioned above, which is encountered first by the moving web or roll. Later the moving web or roll passes nearby to the edge of the nozzle 55, which is the "trailing edge" mentioned above.

In FIG. 2, we can see the cleaning shell 21 which is on an arm that rotates about a pivot rod 23. When the cleaning shell 21 rotates clockwise in FIG. 2 it is able to cover the offline nozzle 55 for cleaning. Return funnel 64 may also be seen, which catches excess coating so that it may be recycled.

FIG. 2*a* shows a detail of the area where the nozzle 55 and roll 6 are nearby to each other. Back seal 7 may be clearly seen. It and the trailing or metering edge of the nozzle 55 help to define the cavity through which coating passes (upwards and to the right in FIG. 2*a*) from the nozzle toward the roll.

Figure 3:
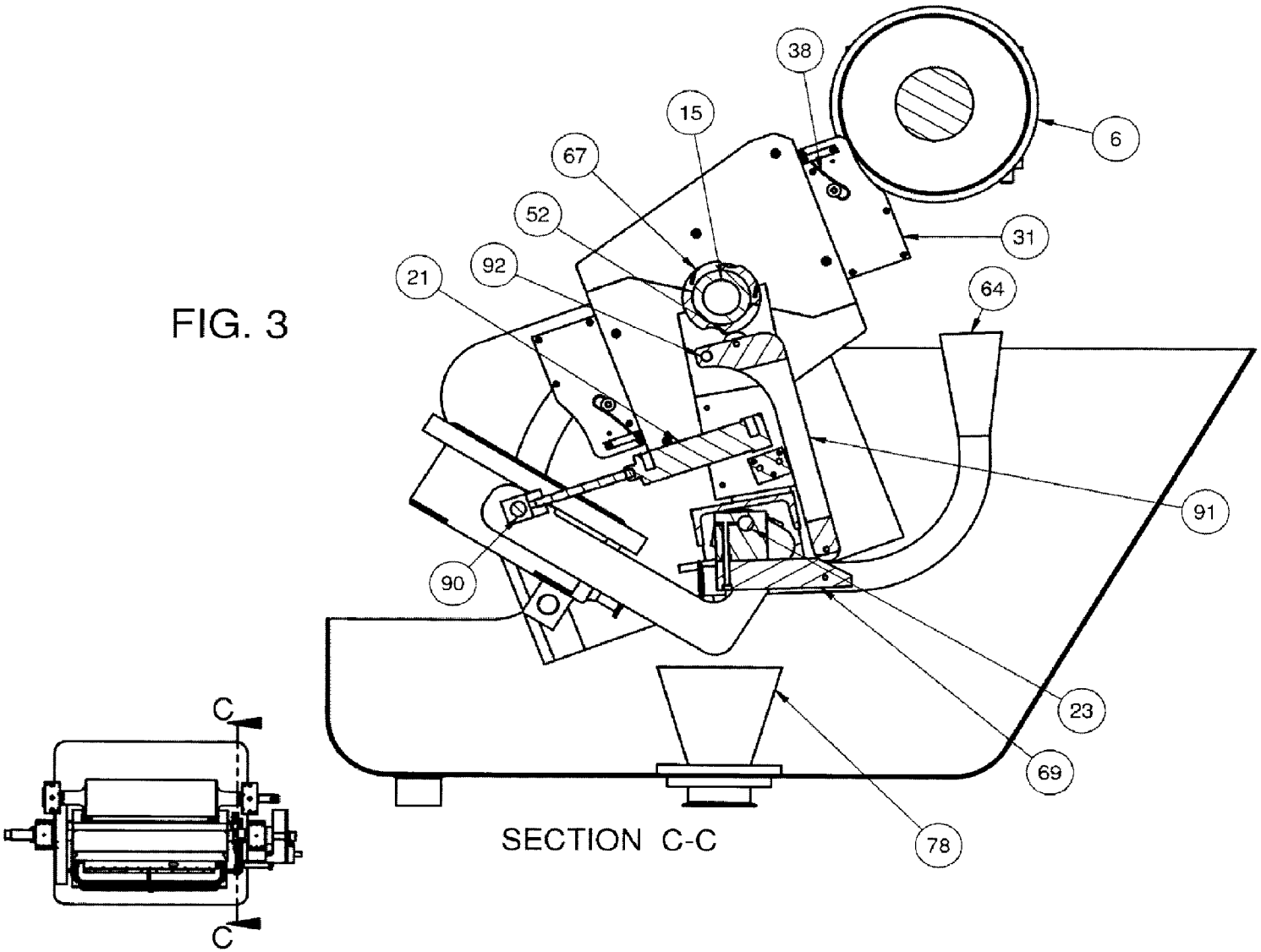
FIG. 3 is a broken-away view though the return funnel and cleaning shell actuators looking to the return funnel and the cleaning shell on the locking device side of the pressure feed application system coater with return funnel 64 and cleaning shell 21 open. In this FIG. 3, the roll 6 rotates clockwise.

FIG. 3 is another view in the same direction as that of FIG. 2. The center shaft 15 may be seen. When the frame rotates 180 degrees to change from one nozzle 55 to the other, the rotation takes place about the axis of this shaft 15. End seal spring 38 may be seen, which permits adjustment of the end seal, about which more will be said later.

Returning to FIG. 1, it was mentioned that locking device 97 permitted locking the nozzles into place with one in an "online" position nearby to the roll 6 and the other in an "offline" position nearby to the cleaning shell 21. FIG. 4 shows some of the moving parts of the locking device 97, in particular an angle adjustment pin 3 which permits subtle adjustment of the angle at which the nozzle 55 attacks the application surface. This will be discussed in great detail below.

Figure 7:
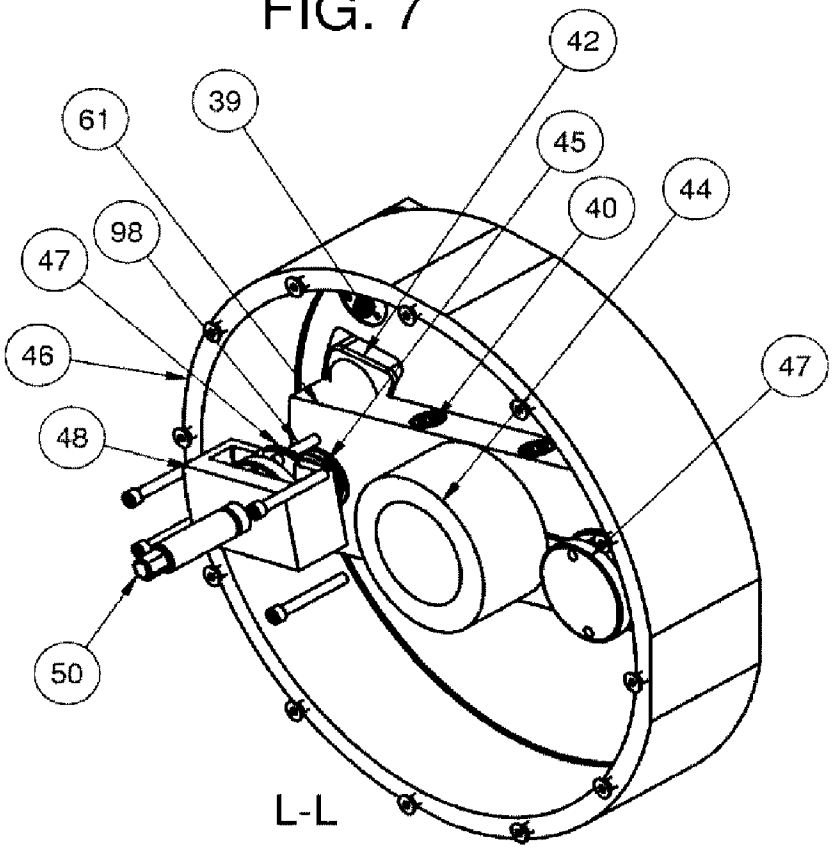
FIG. 7 is a perspective view of the locking device with the outside cover removed. The locking pin pusher screw 50 is visible.
Figure 6:
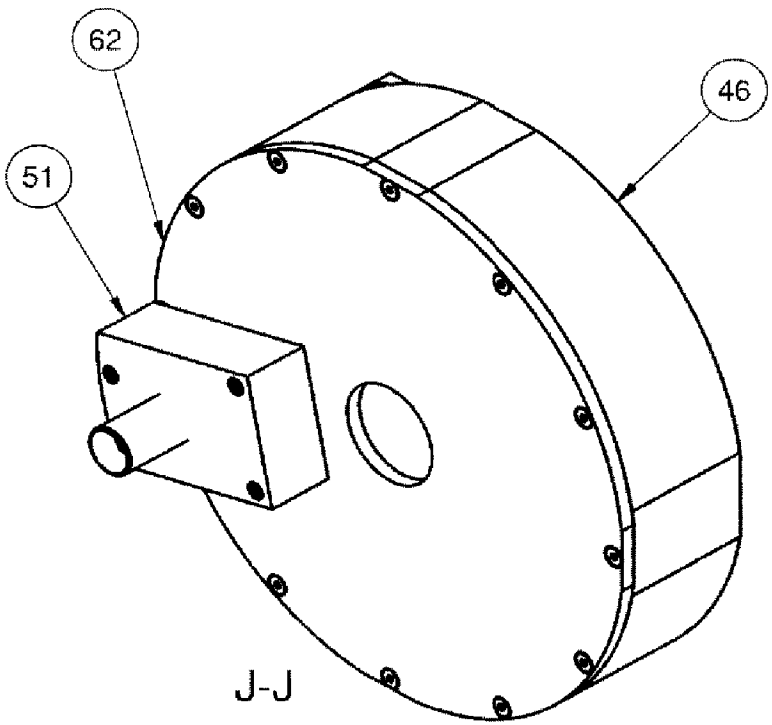
FIG. 6 is a perspective view of the locking device with a protective outside cover in place.
Figure 8:
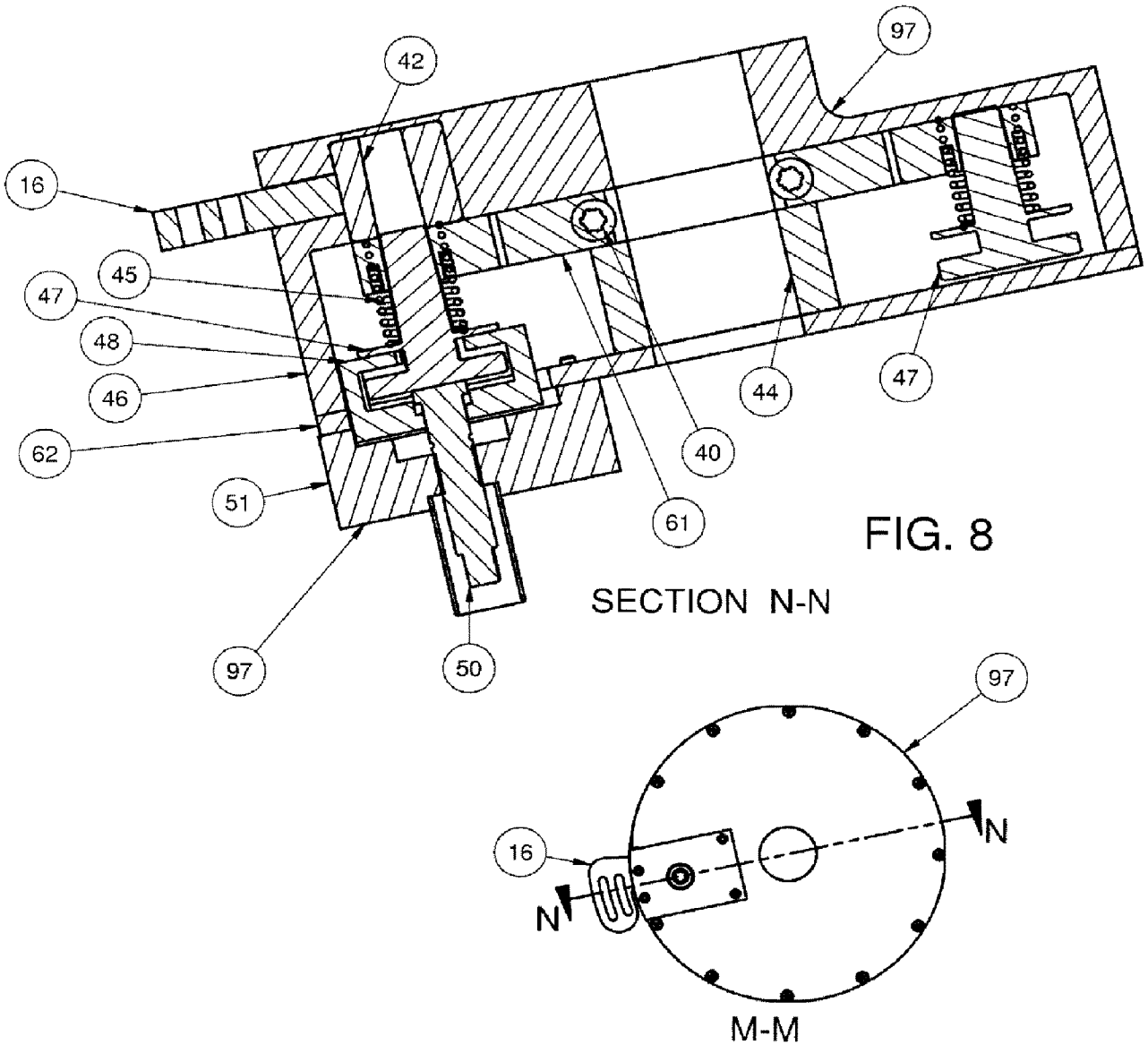
FIG. 8 is a broken-away view of the locking device 97 though the center of the locking pins 47.

FIGS. 6 and 7 show an external and an internal view of the locking device 97. A locking pin pusher screw 50 permits releasing the bar so that it rotates freely, or engages a locking pin so that one or the other of the nozzles 55 is locked into place nearby to the roll 6. This will be discussed in great detail below.

The above-mentioned angle adjustment pin 3 (FIG. 4) permits adjusting the angle of attack of the online nozzle 55 toward the application surface. As may be seen from FIG. 9 (which omits both the bar 200 for clarity), moving around the online nozzle 55 necessarily moves around the offline nozzle 55. Necessarily, the cleaning shell assembly 26 needs to move in whatever direction is needed so that it continues to engage the offline nozzle 55. (If the cleaning shell assembly were to fail to move in response to adjustments of angle adjustment pin 3, then it would fail to engage the offline nozzle 55 and solvent would leak or spray out in an uncontrolled fashion.) Thus, as will be discussed in great detail below, the cross-connection bar 43 rotates about the shaft 15 (FIG. 3) and, because of a connection by means of the arm lock attachment 18, rotates to match the nozzle angle determined by the angle adjustment pin 3. In this way the cleaning shell assembly 26 is moved in whatever way is needed to follow the offline nozzle 55.

In this way too, the return funnels 27 move in whatever way is needed to follow the online nozzle 55, as will be discussed below.

Figure 11:
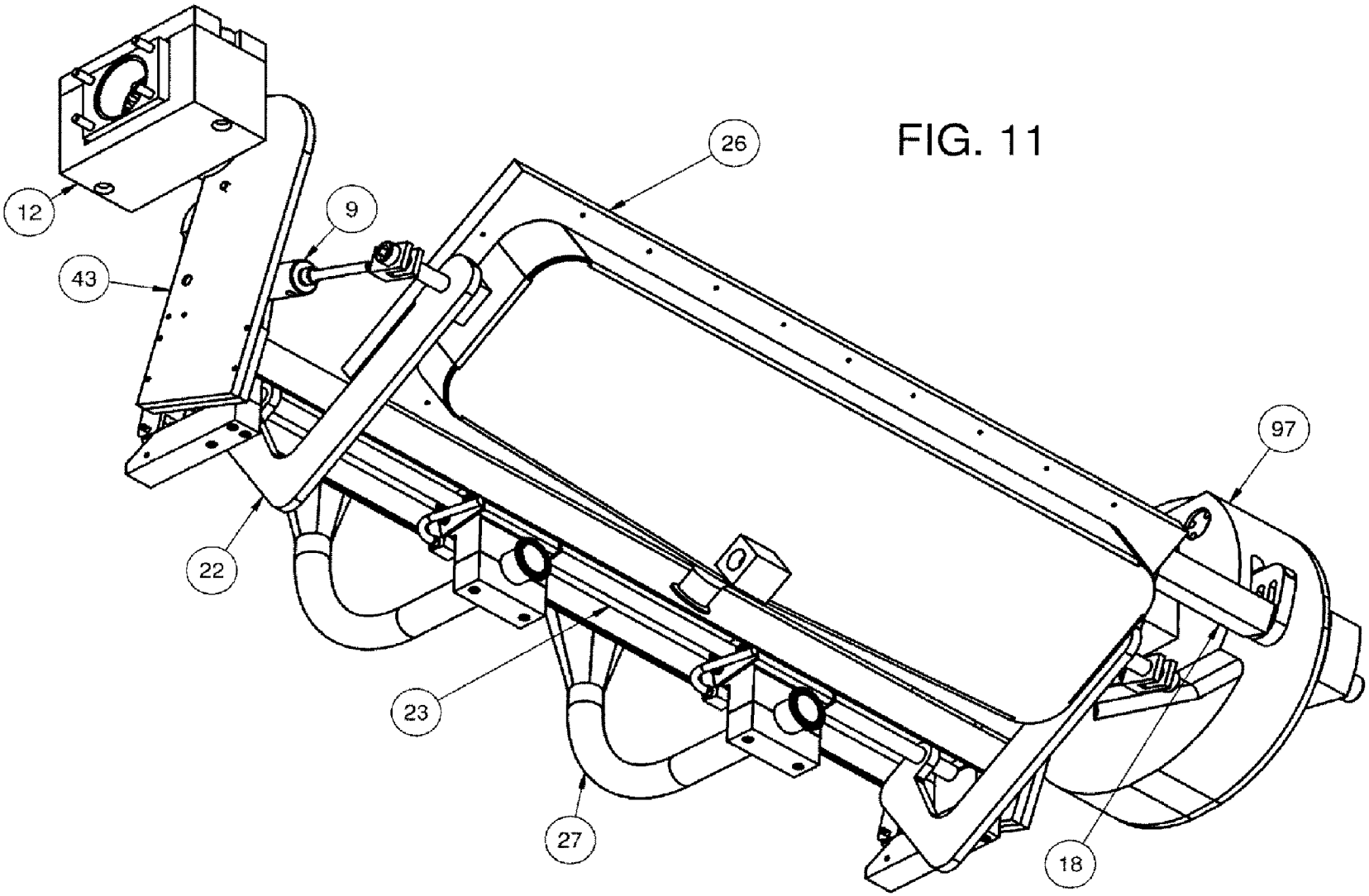
FIG. 11 is a perspective view of the cross-connection frame 43, return funnel assembly 27, cleaning shell assembly 26, and locking device 97 from below.
Figures 12, 13:
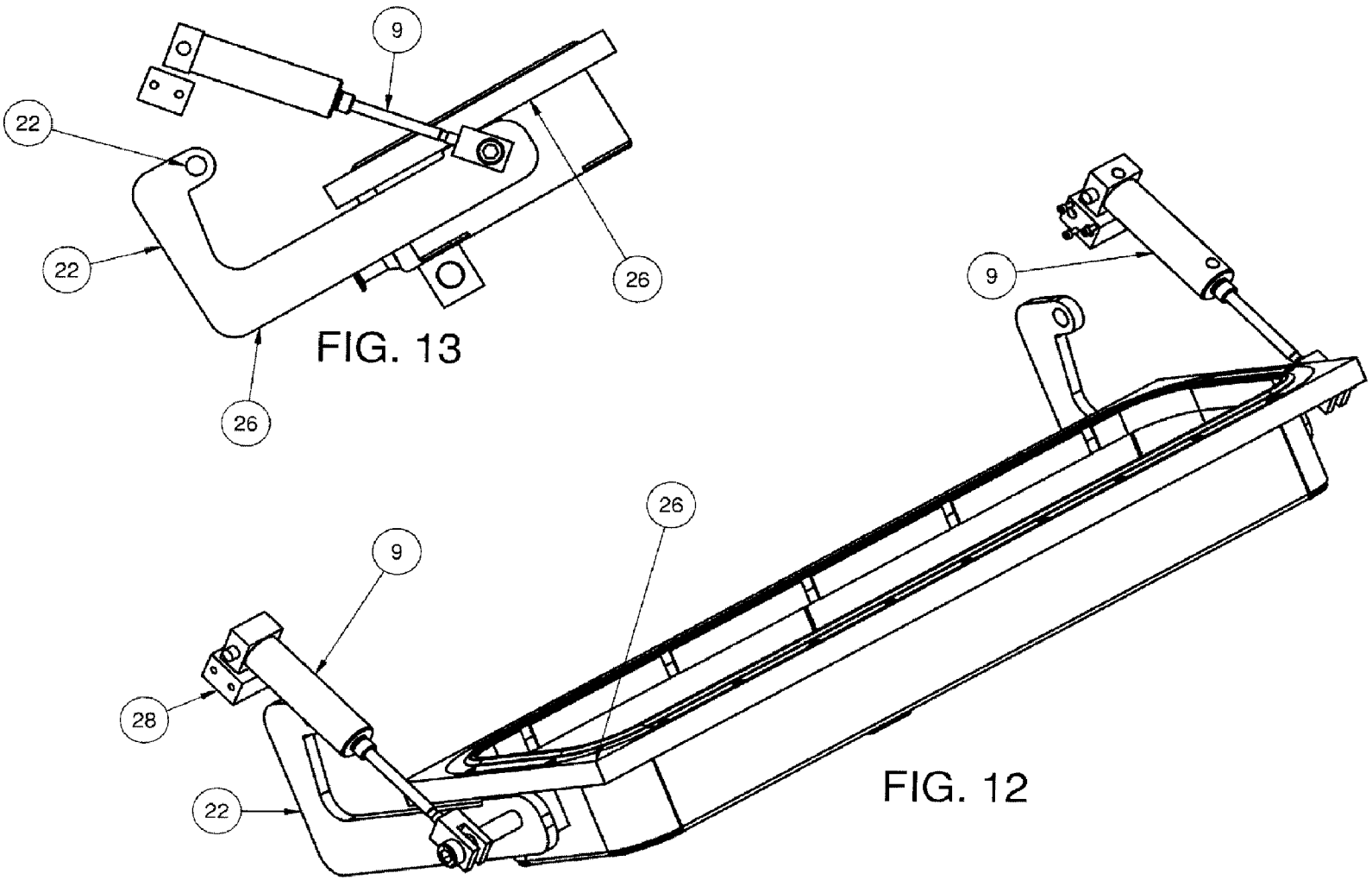
FIG. 12 is a perspective view of the cleaning shell assembly 26.
FIG. 13 is an end view of the cleaning shell assembly 26.
Figure 14:
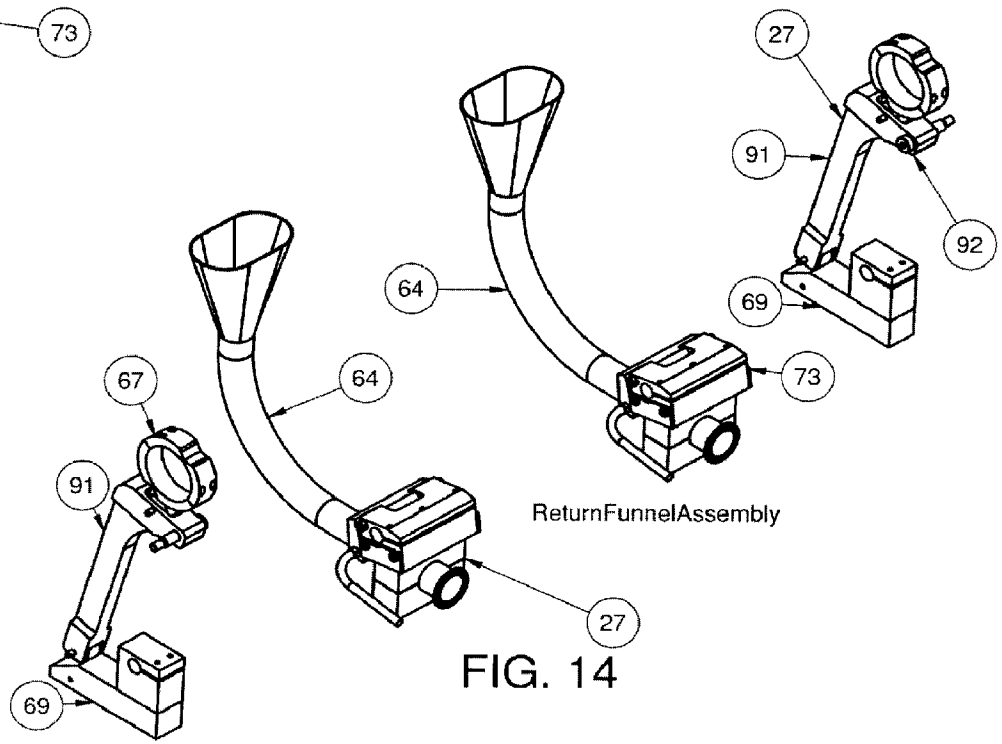
FIG. 14 is a perspective view of the return funnel assembly 27.
Figure 15:
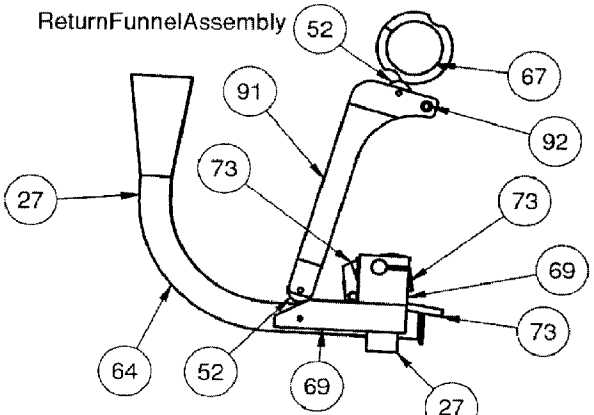
FIG. 15 is an end view of the return funnel assembly 27.
Figure 16:
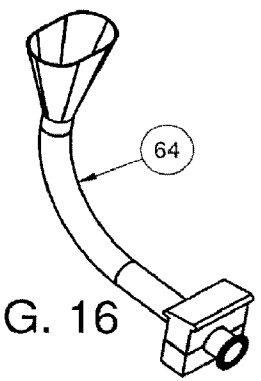
FIG. 16 is a perspective view of the return funnel 64.
Figures 17, 17A:
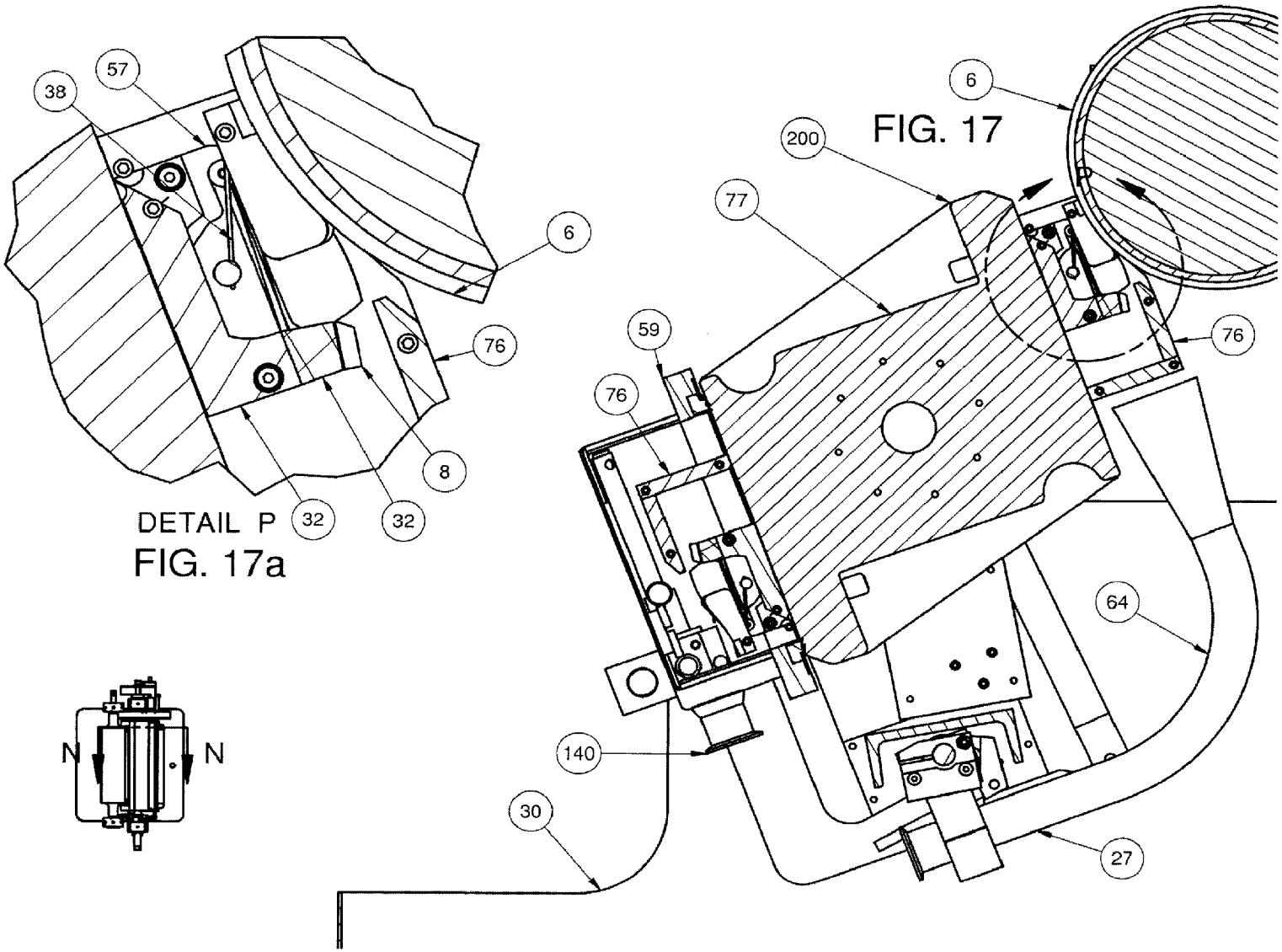
FIG. 17 is a broken-away view from the end of the roll body viewing toward the end seals with the return funnel 64 closed (in operating position). Return troughs 76 can be seen which catch any errant coating so that it may be recycled.
FIG. 17*a* shows an end seal area and a portion of a return trough 76 in greater detail. In these FIGS. 17 and 17*a*, the roll 6 rotates clockwise.

FIG. 11 shows, in perspective view from below, the cleaning shell assembly 26. Pneumatic cylinder 9 may be seen which moves the cleaning shell assembly toward the offline nozzle (upwards in FIG. 11) to clean it. Once again the arm lock attachment 18 may be seen which causes the cleaning shell assembly 26 and return funnels 27 to track closely any angular adjustment in the nozzles 55 due to the angle adjustment pin 3 (not visible in FIG. 11).

When the nozzles 55 are being rotated 180 degrees (so that the online nozzle becomes the offline nozzle, and vice versa) it is necessary to move the return funnels out of the way (downwards in FIG. 17) so that they do not collide with the return troughs 76. In this particular design the bar 200 is turned by hand after the locking device is released as described in detail below. When the bar 200 is rotated, a cam 67 turns with the nozzles 55. Cam follower 52 engages either of two detents in cam 67 when one nozzle or the other is in place toward the application surface, and when this happens the return funnels 27 are upwards and nearby to the online nozzle 55. On the other hand, when the nozzles are rotating, the non-detent portions of the cam 67 force the cam follower 52 downwards, thus forcing the spring-loaded return funnels 27 downward, out of harm's way during the nozzle rotation.

Figure 18:
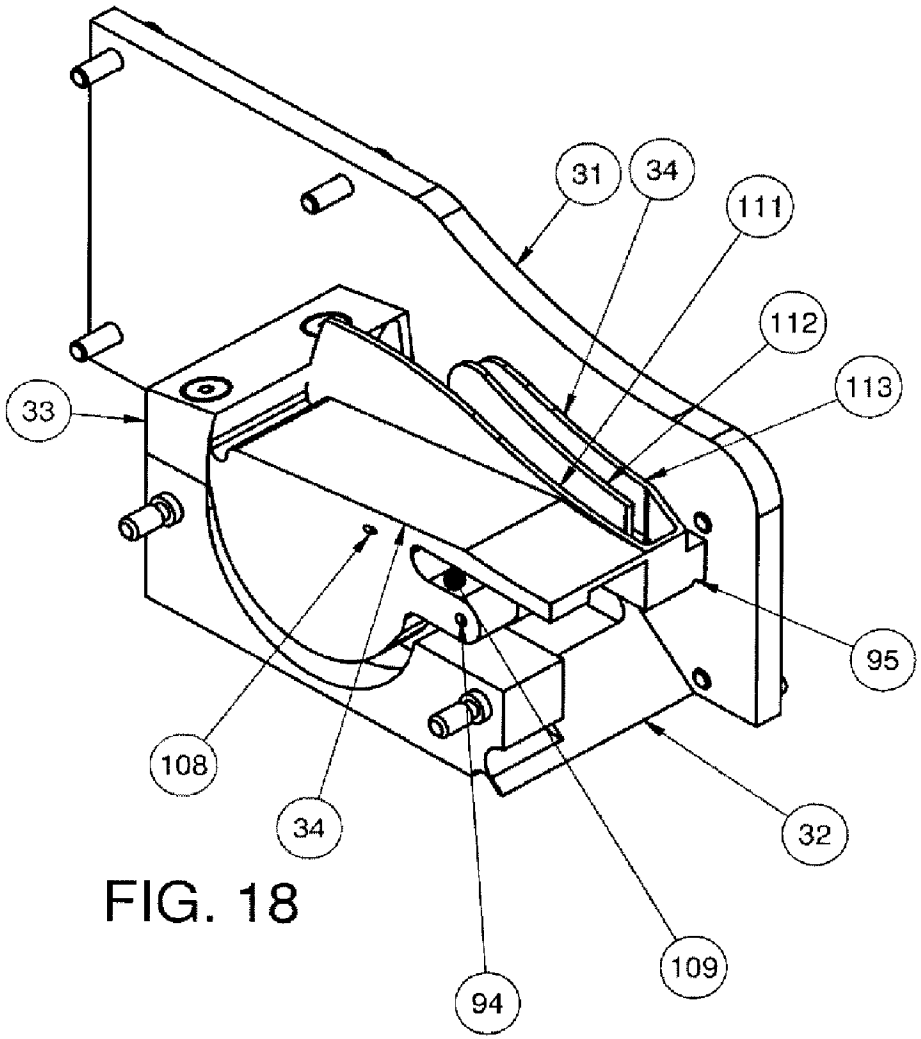
FIG. 18 is a perspective view of a first embodiment of an end seal according to the invention.

FIG. 18 is a perspective view of a first embodiment of an end seal design according to the invention. Omitted for clarity in FIG. 18 are the back seal 7 and trailing edge of the nozzle 55, which if shown would extend to the lower left in FIG. 18. First seal lip 111 may be seen, along with second seal lip 112 and third seal lip 113. Applicator roll 6 is likewise omitted for clarity in FIG. 18. Its direction of movement is toward the lower left in FIG. 18.

Figure 20:
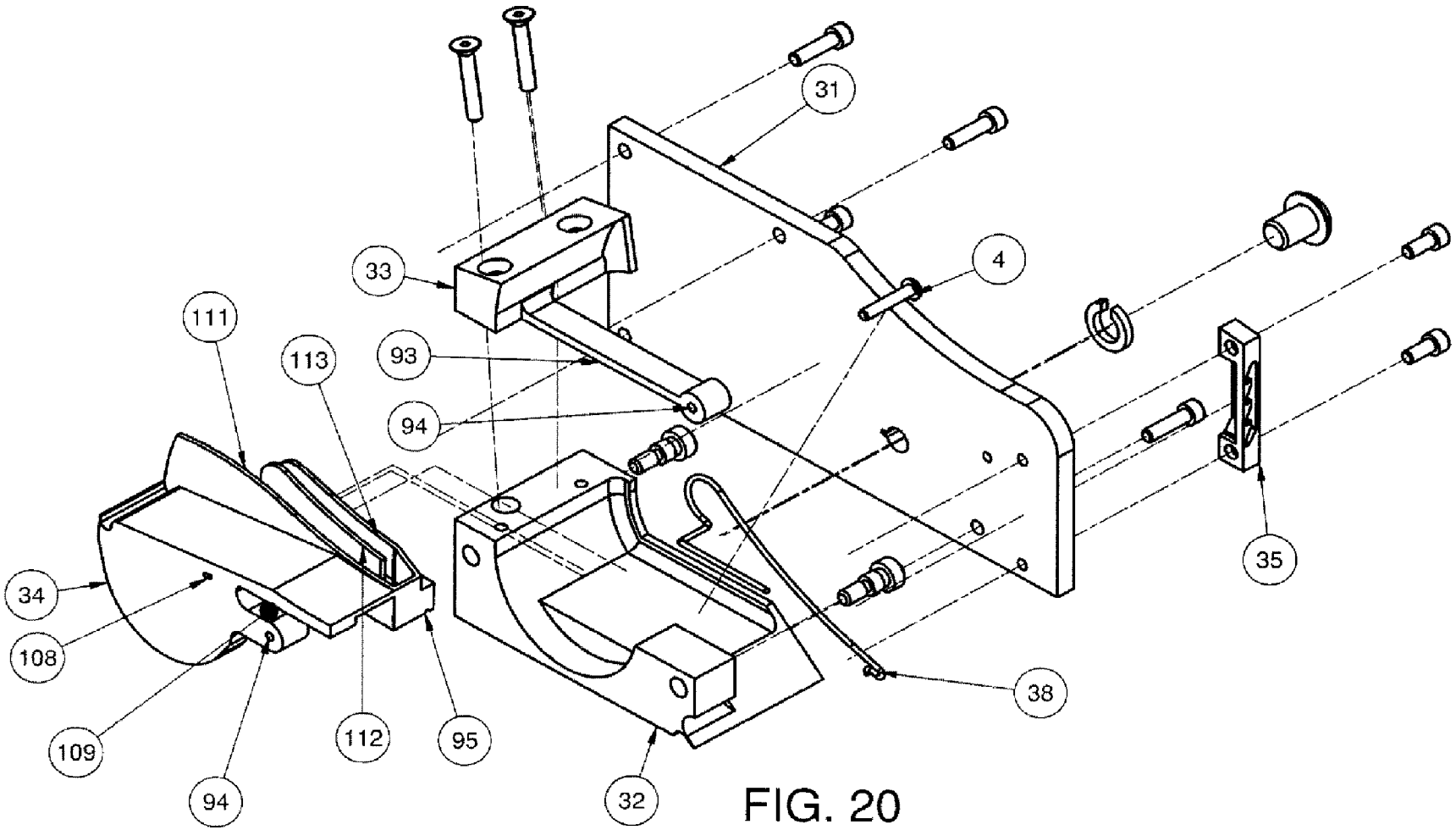
FIG. 20 is an exploded view of the end seal.
Figure 21:
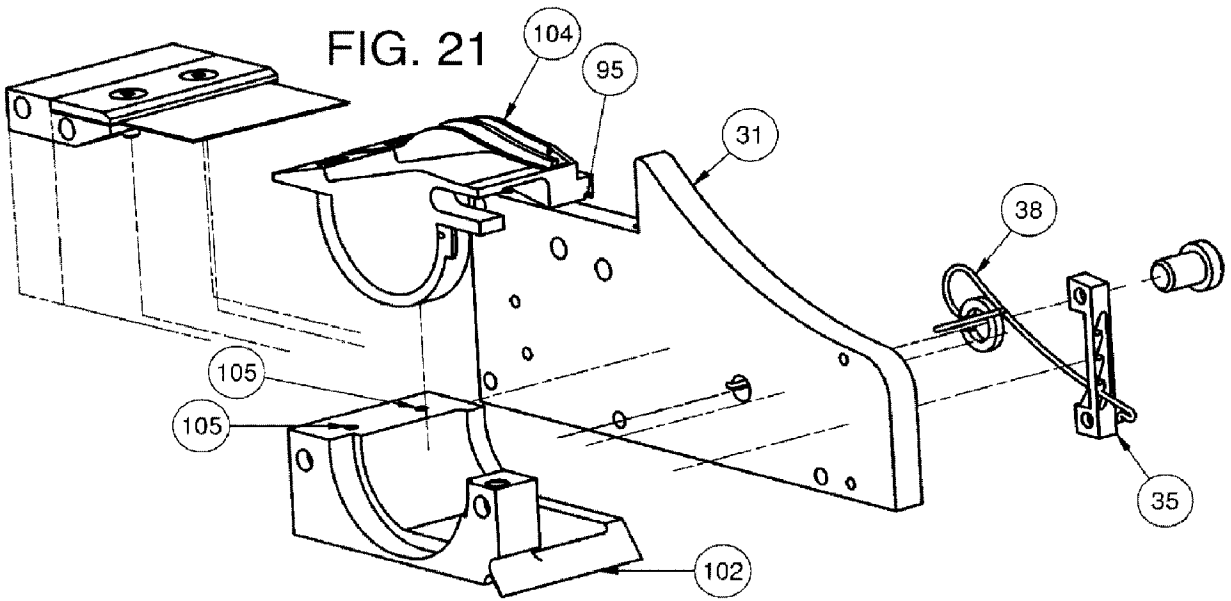
FIG. 21 is an exploded view of a second embodiment of an end seal according to the invention.
Figures 24, 25:
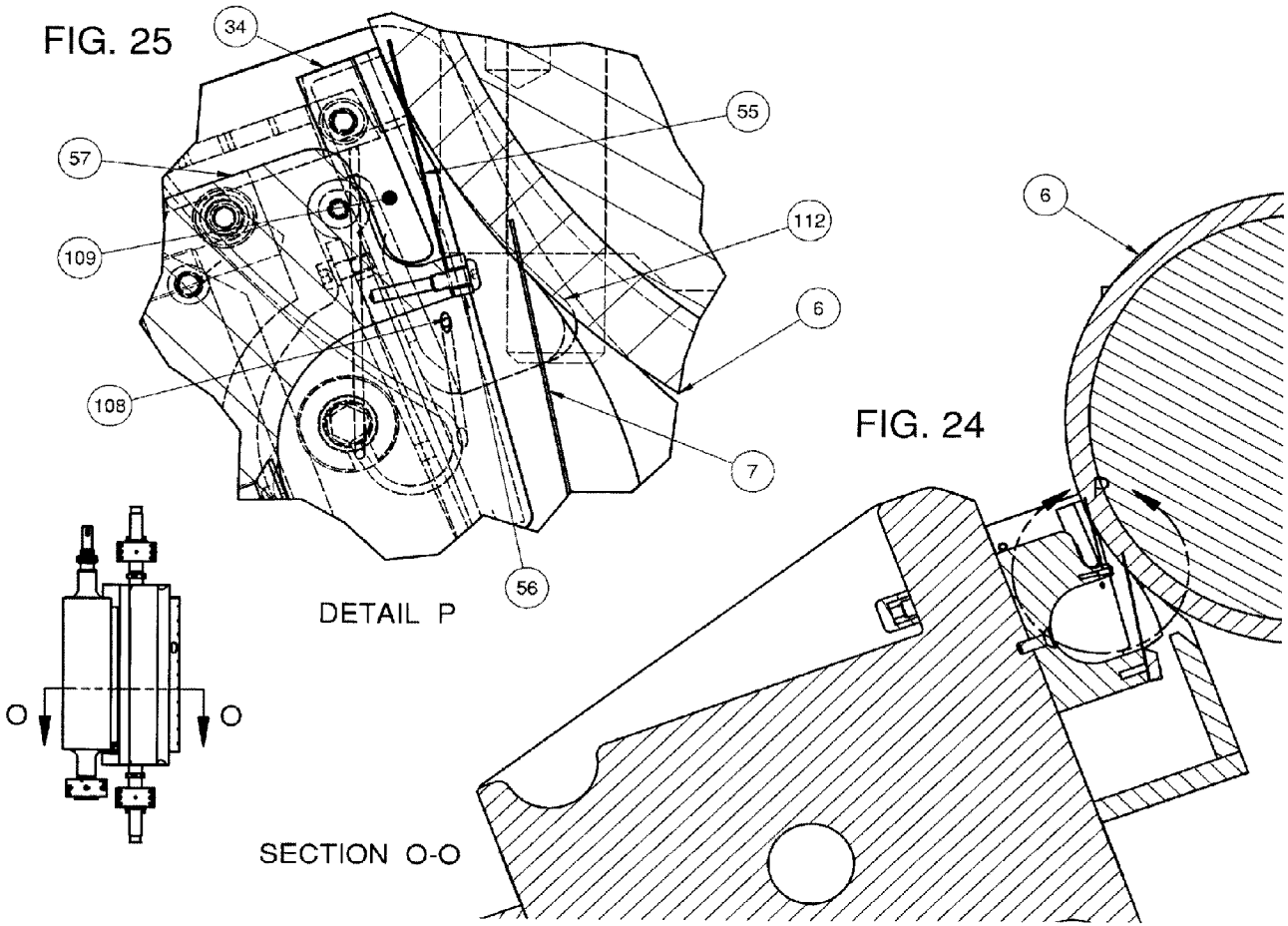
FIG. 24 is a broken-away view through the application roll and the pressure feed application system bar nozzle/end seal illustrating the proper fit between the end seal and the application surface.
FIG. 25 is a detail view of nozzle/end seal portion of FIG. 24. In these FIGS. 24 and 25, the roll 6 rotates clockwise.
Figures 26, 27:
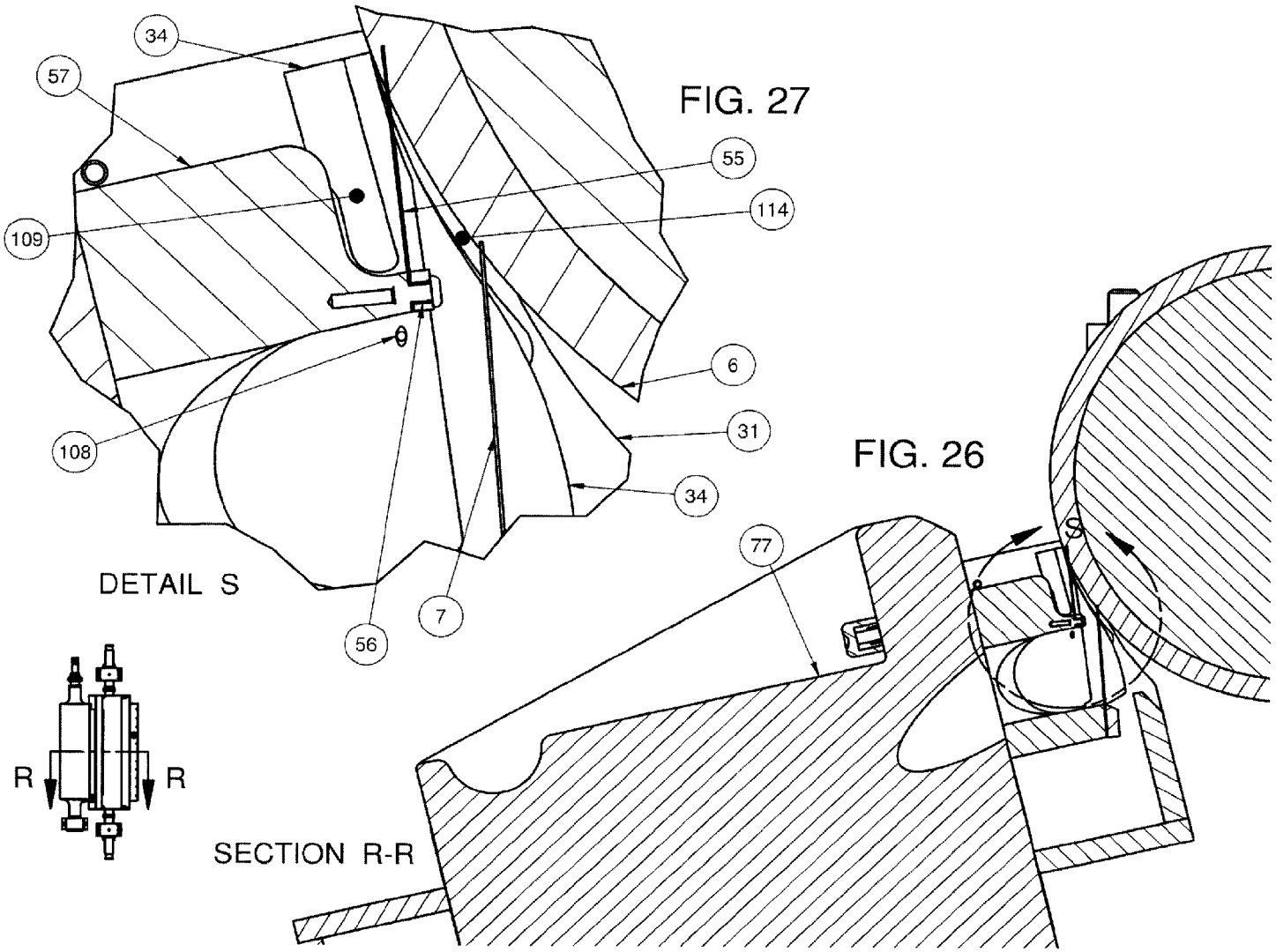
FIG. 26 is a broken-away view through the application roll and the pressure feed application system bar nozzle/end seal illustrating an first example of an improper fit of an end seal to an application surface caused by the nozzle being rotated down 0.4 degrees.
FIG. 27 is a detail view of nozzle/end seal portion of FIG. 26. In these FIGS. 26 and 27, the roll 6 rotates clockwise.
Figures 28, 29:
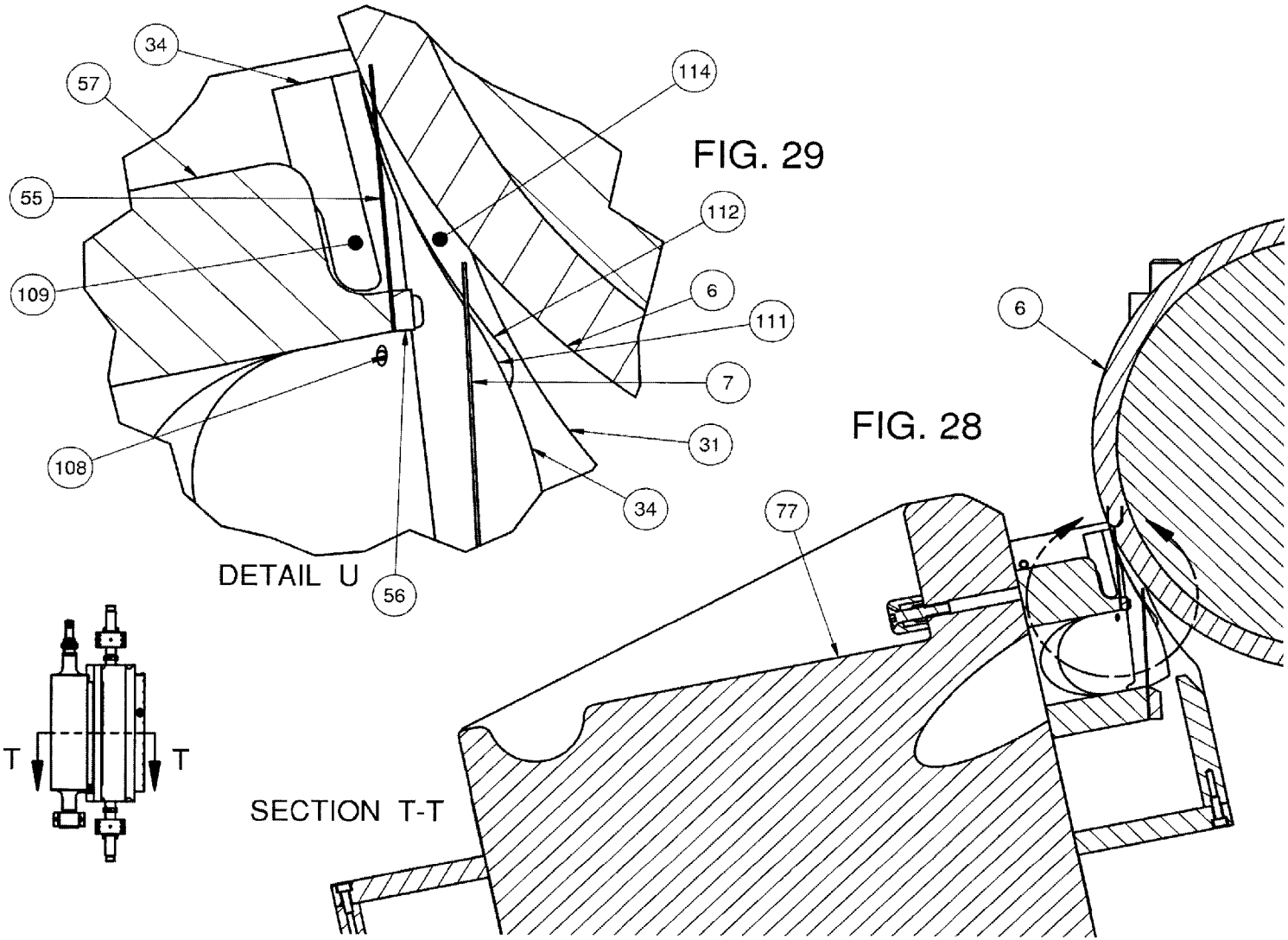
FIG. 28 is a broken-away view through the application roll and the pressure feed application system bar nozzle/end seal illustrating a second example of an improper fit of the end seal to the application surface caused by the nozzle being rotated down 0.8 degrees
FIG. 29 is a detail view of nozzle/end seal portion of FIG. 26. In these FIGS. 28 and 29, the roll 6 rotates clockwise.
Figure 33:
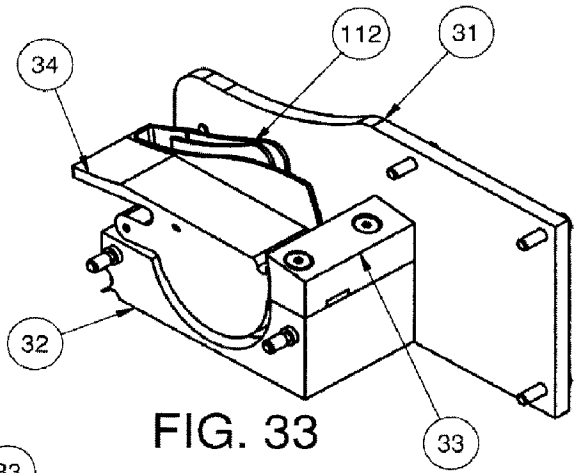
FIG. 33 is an end seal under this condition in perspective view.
Figure 32:
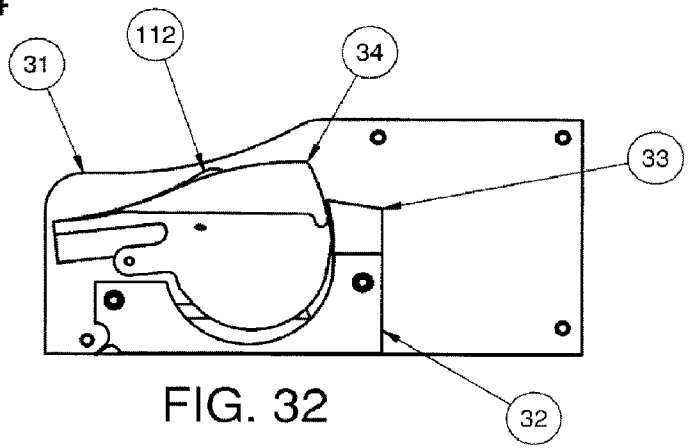
Figure 34:
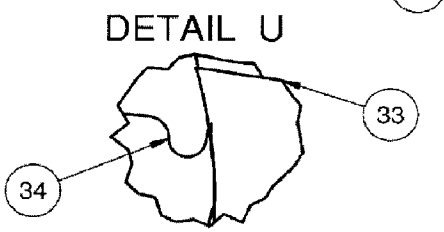
FIG. 34 is a detail of the internal seal area.
Figure 31:
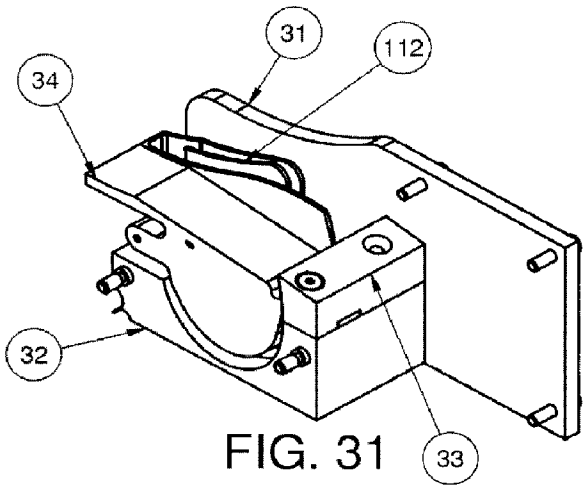
FIG. 31 is an end seal under this condition in perspective view.
Figure 30:
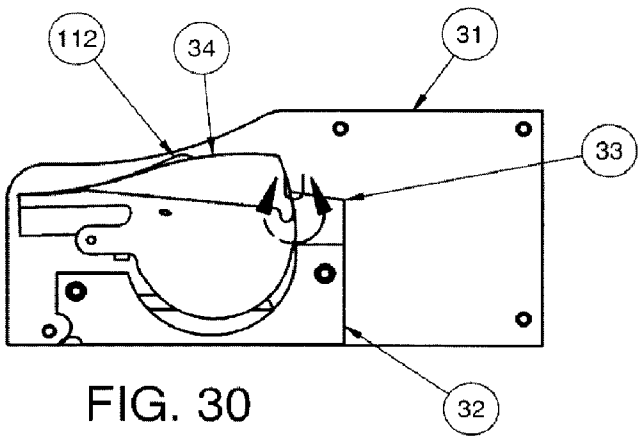
Figure 38:
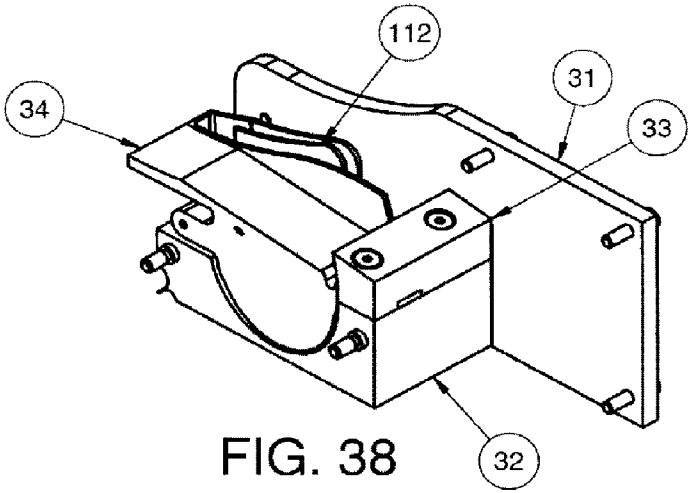
FIG. 38 is an end seal under this condition in perspective view.
Figure 37:
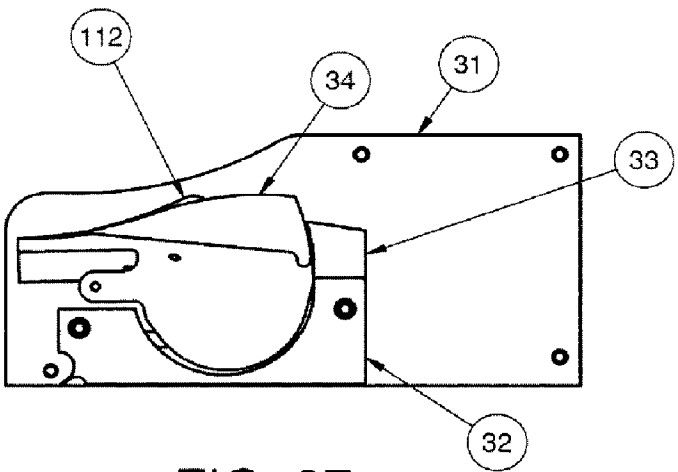
Figure 36:
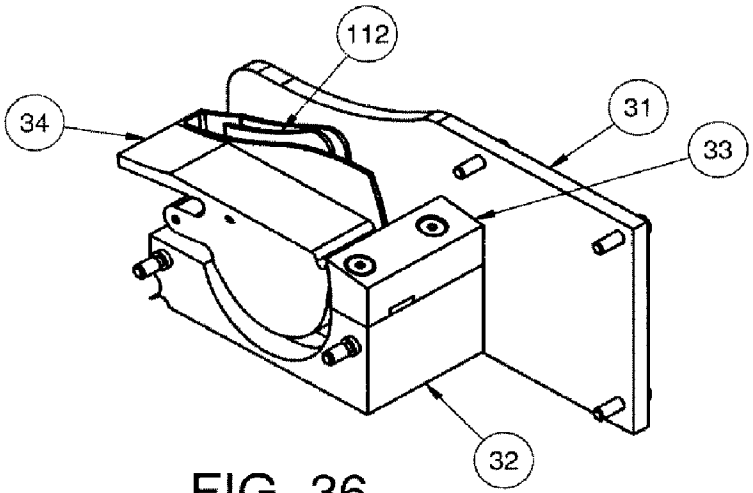
FIG. 36 is an end seal under this condition in perspective view.
Figure 35:
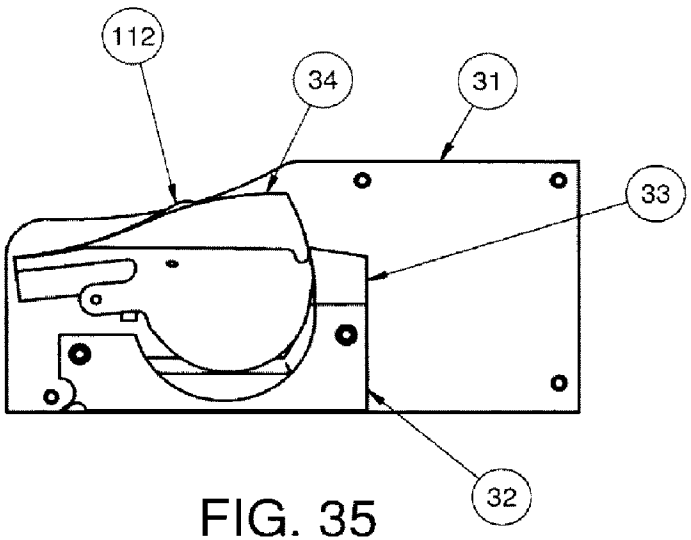

FIG. 20 is an exploded view of the end seal of FIG. 18. In this view we can see a springy section 93 which tends to urge seal top 34 (which incorporates lips 111, 112, 113) upwards toward the roll 6 that is omitted for clarity in this FIG. 20. In addition, a spring 38 permits an adjustable force upwards on the end of the seal top 34 as well (that is, on the trailing edge of the seal), again toward the roll 6. This is the same spring 38 the exterior portion of which which was visible in FIG. 3.

It is evident from FIG. 18 that the first seal lip 111 and third seal lip 113 are joined together toward 95. The springy section 93 which may be seen in FIG. 20 may also be called a flexible bracket.

FIG. 22 shows a perspective view of a second embodiment of an end seal design according to the invention. As in FIG. 20, back seal 7 and trailing edge of nozzle 55 extend toward the lower left in FIG. 22 and are omitted for clarity. As detailed in FIG. 23, there are again lips 111, 112, 113 which help to seal the end of the nozzle. As in FIG. 20, a spring 38 permits adjustment of the force upwards, on the end of the seal at its trailing edge, toward the applicator roll 6, omitted for clarity. As in FIG. 20, the applicator roll 6, if visible, would move downwards and to the left in FIG. 22.

The invention, as portrayed in the figures, will now be discussed in great detail, starting with the nozzle locking and angle adjustment features and then turning to the end seal features.

Nozzle Locking and Angle Adjustment

The pressure feed application system bar locking device 97 is shown in FIGS. 1, 4, 5, 6, 7, 8, 9 and 11. It is used to precisely position the pressure feed application system bar nozzles relative to the application surface. It also drives the position of the return funnels and cleaning shell. It will permit the nozzles to be precisely positioned to fractions of a degree. The accuracy for positioning is determined by the pitch of the threads on the angle adjustment pin 3 (FIG. 4) and by overall manufacturing tolerances. In addition, the locking device 97 allows the pressure feed application system bar 200 to be rotated 180 degrees to quickly change nozzles while allowing the return funnels 64 and cleaning shell 21 to maintain an unchanged and proper orientation to the pressure feed application system bar 200. This system can easily be replaced with a servo-motor and gearbox or hydraulic system to permit automated control of the pressure feed application system bar angle, however this involves considerably more cost. Either approach (manual adjustment of the adjustment pin 3, or automated control) falls within the scope of the present invention.

The locking frame, 46, is typically attached to one of the outboard bearing yokes 60 on the centerline of the pressure feed application system center shaft 15. The outer locking ring 61 is clamped to the center shaft 15 using its clamping bolts 40. The locking pins 47 are always captured inside the outer locking ring 61 while contained by the outside cover 62 or the locking pin puller collar 48. The locking pins 47 are spring-loaded outward toward the outside cover 62 at all times. When the locking pin pusher screw 50 is retracted, then both locking pins 47 are retracted.

It will be appreciated that the locking pin pusher screw 50 could be replaced with any of several different devices to automate the process without deviating in any way from the invention. For instance an air cylinder could be used.

When the locking pin 47 is retracted, the pressure feed application system bar is free to be rotated 360 degrees. When it is desired to lock the pressure feed application system bar, the unit is rotated to approximately its production position and the locking pin pusher screw 50 is tightened. This action pushes the locking pin 47 into engagement with the floating pivot block 42. The locking pin 47, the hole in the outer locking ring 61, and the hole in the floating pivot block 42 are tapered insuring precise and repeatable location control. The floating pivot block 42 is firmly locked into angular alignment by means of the angle adjustment pin 3, fixed adjustment pivot 39, and the floating pivot 41. The fixed adjustment pivot 39 is constrained in the locking frame 46 in the direction axial to the angle adjustment pin 3. The floating pivot 41 is constrained by the floating pivot block 42, in the direction axial to the angle adjustment pin 3. The angle adjustment pin 3 is threaded into the floating pivot 41. This is shown for example in FIG. 4.

In one embodiment, the angle adjustment pin 3 has a hex head end. Rotating the hex head end of the angle adjustment pin 3 pushes or pulls the floating pivot block 42 along the axis of the angle adjustment pin 3, causing the floating pivot block 42 to rotate around the centerline of the locking frame 46, which is the centerline of the pressure feed application system bar center of rotation.

The cleaning shell locking bracket 16 mounts to the floating pivot block 42. One end of the cleaning shell arm lock attachment 18 (see FIG. 9) connects to the cleaning shell locking bracket 16, while the other end connects to the cross-connection frame 43 (shown in FIG. 10). This cross-connection frame 43 and its location are important. The cross-connection frame 43 is used as a rigid support platform for mounting of the cleaning shell assembly 26 and the return funnel assembly 27 (see FIG. 9). The movement of the return funnels 64 and the cleaning shell 21 are based upon the cross-connection frame 43. The mounting points for the cleaning shell 21 and the return funnel 64 are below the pressure feed application system bar 200. Mounting these items below the bar provides clearance for operator access to necessary equipment, while permitting the cleaning shell 21 and the return funnel 64 always to be properly oriented with respect to the pressure feed application system bar and return troughs. The mounting hardware and actuators for both the cleaning shell 21 and the return funnel 64 may vary without departing from the invention, but the rotational position control around the pressure feed application system centerline must be from the locking device 97, or must be a locking device that coordinates the pressure feed application system bar to the cross connection frame 43, or must provide precise pressure feed application system bar coordination to return funnel and cleaning shell hardware on both ends of the bar through electromechanical means.

The mounting hardware may be rotational as shown in FIGS. 2 and 3 or may be linear such as on linear slides. The actuators can be pneumatic as the cleaning shell assembly is shown, can be driven through simple levers like the return funnels, can be purely manually driven or can be positioned by any of several other mounting and drive mechanisms, all without departing from the invention.

Figures 9, 10:
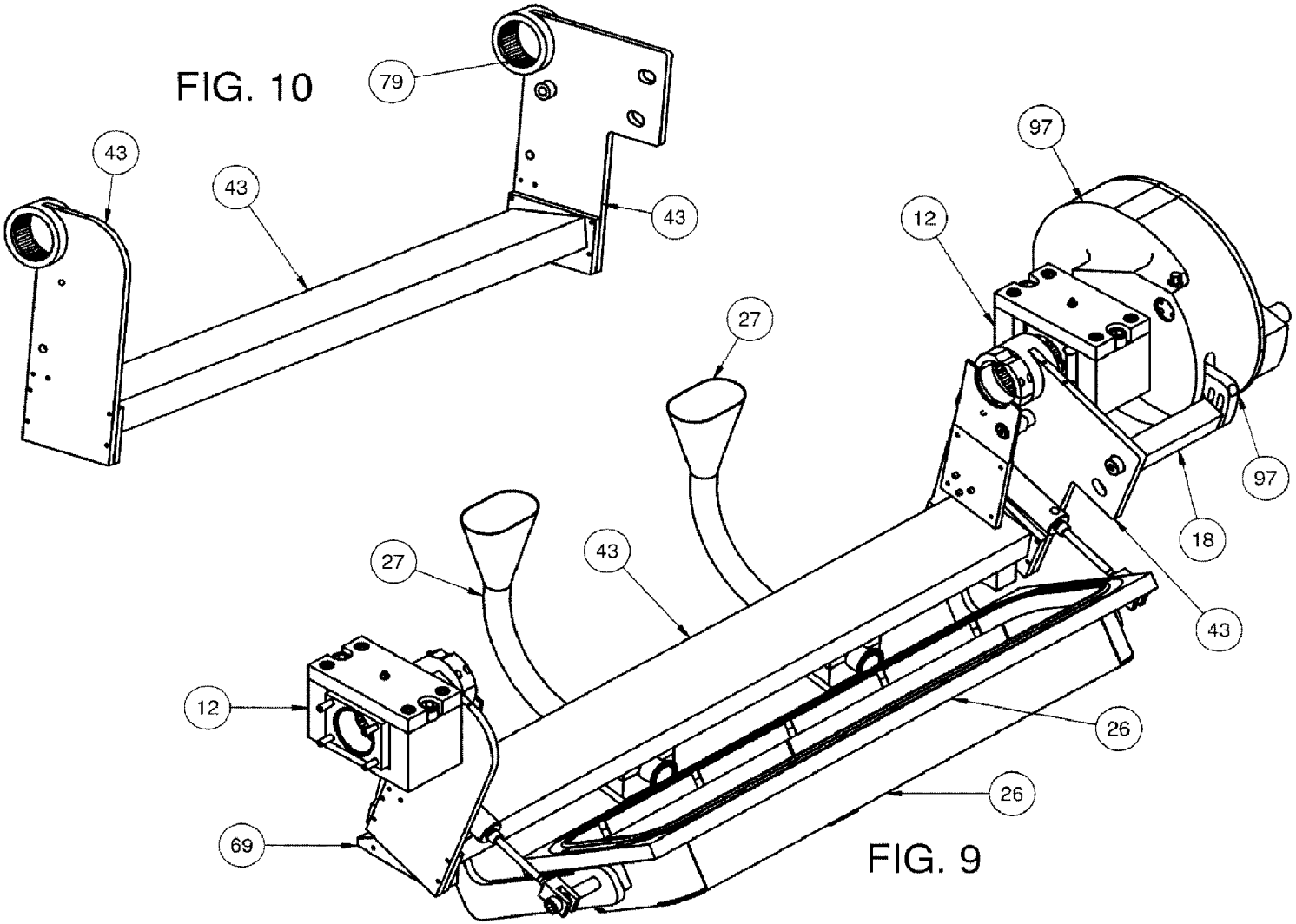
FIG. 9 is a perspective view of the cross-connection frame 43, return funnel assembly 27, cleaning shell assembly 26, and locking device 97.
FIG. 10 is a perspective view of the cross-connection frame 43.

At such times as the pressure feed application system bar is being rotated, the cleaning shell 21 and return funnels 64 are maintained in the proper position by the cleaning shell locking bracket 16, through the cross-connection frame 43. The motion of the cleaning shell assembly 26 and the return funnel assembly 27, while located by the cleaning shell locking bracket 16, are operated independently of one another. The cross-connection frame 43 is bolted to the cleaning shell locking bracket 16. A fastener is connected to the end of cleaning shell arm lock attachment 18 which passes through a hole in the cross-connection frame 43. The cross-connection frame 43 is mounted centered on the center shaft 15 of the pressure feed application system bar through needle bearings 79 (FIG. 10). The cross-connection frame 43 rigidly connects both ends of the assembly for mounting the cleaning shell assembly 26 and return funnel assembly 27 together. This connection is not necessary if a locking device is used on both ends of the pressure feed application system bar 200. A locking device on both ends is rarely needed and creates many new problems.

In order to rotate the pressure feed application system bar 200, the locking pin pusher screw 50 is retracted. This device then pulls on the locking pin puller collar 48. The locking pin puller collar 48 then pulls the locking pin 47 out of the locating hole. The spring 45 pushes the locking pin 47 tight against the locking pin puller collar 48 to insure complete extraction from the floating pivot block 42. Once the locking pin 47 is completely retracted the pressure feed application system bar can be rotated. Each locking pin 47 remains mated with each hole in the outer locking ring 61. The locking pin 47 is held tight against the outside cover 62 during rotation. Optional dowel pins 98 (FIG. 7) insure the locking pin 47 remains properly oriented to avoid binding. After the pressure feed application system bar is rotated 180 degrees the locking process can be repeated.

The floating pivot block 42 that contains the tapered hole for the locking pin 47 can be rotated to different precise angles around the center shaft 15 by turning the angle adjustment pin 3. The angle adjustment pin 3 is locked into a fixed center position in the locking frame 46 by the fixed adjustment pivot 39. As the angle adjustment pin 3 is rotated, the fixed adjustment pivot 39 is allowed to rotate, but its centerline in the locking frame 46 does not change. The floating pivot 41 hole for the angle adjustment pin 3 is threaded. As the angle adjustment pin 3 is turned the floating pivot 41 moves toward or away from the fixed adjustment pivot 39 along the centerline of the angle adjustment pin 3. This in turn will move the floating pivot block 42 and the return funnel mounting block 16 rotating the pressure feed application system bar 200, cleaning shell assembly 26, and return funnel assembly 27, together relative to the application surface.

The cleaning shell 21 proper and the mechanisms for positioning it are all mounted to the cross connection frame 43. The cleaning shell pivot arm 22 pivots around a cleaning shell pivot rod 23 that is part of the cross-connection frame 43. The cleaning shell-PivotArm 22, supports pivots on both ends of the cleaning shell 21. A cylinder 9 with its trunnion end attached to the cross connection frame 43 above the cleaning shell pivot rod 23 and the end of the rod connected to the cleaning shell 21 is used to open and close the cleaning shell 21. Mounting and actuating the cleaning shell 21 to the cross connection frame 43 insures the cleaning shell 21 is always positioned to seal properly regardless of the nozzle angle to the application surface.

The return funnels 64 and the return funnel assembly 27 are also mounted and controlled to the cross-connection frame 43 (FIGS. 11, 14, 15, 16). The return funnel arm 91 is constrained to the cross-connection frame 43 with a bolt at its pivot point 92. The return funnel arm 91 rotates around this pivot point 92, as it is driven by a return funnel cam 67 and cam follower 52. The return funnel cam 67 is rigidly attached to the center shaft 15 that is rigidly attached to the rigid frame 77 of the pressure feed application system bar. When the pressure feed application system bar and return funnel cam 67 rotate, the cam follower 52 exerts force to move the return funnel arm 91, which in turn exerts force against the return funnel cam follower arm 69, through a cam follower 52. This force results in the return funnel cam follower arm 69 rotating the cleaning shell pivot rod 23. The cleaning shell pivot rod 23 then rotates the return funnel mounting block 73. The return funnels 64 optionally attach to the return funnel mounting block 73 through a quick-release mechanism. Therefore as the pressure feed application system bar is rotated from one nozzle to the other nozzle, the return funnels 64 are rotated from the operating (drain) position out of the way to permit bar rotation, then rotated back into the operating position as the other nozzle reaches its in service position. The return funnel arm 91 is always held tight against the return funnel cam 67 by a spring that attaches to the cross connection frame 43 and return funnel cam follower arm 69. The spring attachment point on the cross connection frame 43 is approximately half-way up the return funnel arm 91 on the cross-connection frame 43. This maintains an upward tension force pulling the return funnel cam follower arm 69 tight against the lower cam follower 52, and the upper cam follower tight against the return funnel cam 67. This cam operated system could also be done manually, hydraulically, or via a pneumatic system, all without departing from the invention.

An important aspect of the design is that the system maintains the proper orientation of the return funnels with the pressure feed application system nozzles as the pressure feed application system bar is operated at different angles to the application surface, and the design permits retraction for bar rotation.

Another way to describe the apparatus according to the invention is that there is a first nozzle and a return funnel 64, with the apparatus positioning the first nozzle and the return funnel relative to an applicator roll 6 or web. The first nozzle comprises an slot elongated along a first axis parallel to center shaft 15 (FIG. 3), the slot defined by a flexible back seal 7 elongated along the first axis and by a metering surface elongated along the first axis, the back seal and metering surface defining a first plane parallel with the first axis. The slot is disposed in osculation with the applicator roll 6 or web along a line parallel to the center shaft 15 which is parallel with the axis of the applicator roll 6. This osculation may be seen for example in FIGS. 2*a*, 17*a* and 24. The apparatus comprises means including, for example, angle adjustment pin 3, by which the first nozzle may be fixed at any of a plurality of orientations so that the first plane is at any of a plurality of respective angles of rotation about the first axis. Preferably the plurality of orientations comprises a continuously adjustable range of orientations, spanning an approximate ten-degree range of angle of rotation.

End Seals

Figure 19:
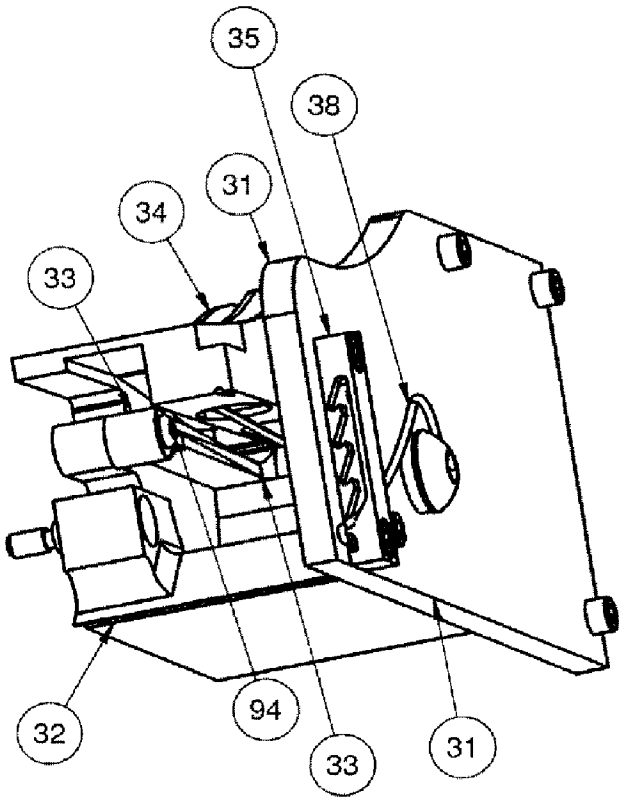
FIG. 19 is a perspective view of the end seal.

The end seals are made of several parts that create a somewhat complicated design but provide a very elegant low-maintenance and reliable end seal. Two different designs according to the invention are disclosed. FIGS. 18, 19 and 20 illustrate one design while FIGS. 21, 22 and 23 illustrate a second design.

The design of the first end seal 120 is built up from a base which is shown as end seal flexible base 32. This base is used for precise attachment to the feed nozzle (38 from U.S. Pat. No. 6,656,529) or nozzle holder 57, and is used for attaching the other components of the end seal 120. The end seal flexible spring 33 (FIG. 20) and end seal cover 31 attach to the base. The end seal flexible spring 33 includes a spring 93 (that can be integral or separate) with a pivot point 94 that constrains the end seal flexible spring top 34. The end seal flexible spring 33 constrains the end seal flexible spring top 34, from being able to move axially away from the nozzle (38 from U.S. Pat. No. 6,656,529) or nozzle holder 57. The spring force should be chosen to be adequate to maintain the seal while not so tight as to create problems with wear or heat generation. The best choice of spring force will vary depending on the roll or substrate material and end seal material selected.

It will be noted that the pivot point 94 is not at the leading-edge end (toward the upper left in FIG. 20) of the seal lips 11, 112, 113 nor is it at the trailing-edge end (toward the lower right in FIG. 20) but is between the two ends. In this way the spring 93 is able to urge the seal lips into contact with the application surface both at the leading-edge end and at the trailing-edge end. Stated differently, if either end of the seal lips were away from the application surface, the spring 93 would tend to urge it toward the application surface (upwards in FIG. 20). This location of the pivot point 94 (between the two ends of the seal) helps the seal to accomplish its goal even if the angle at which the nozzle attacks the application surface changes. In practical terms the angle adjustment pin 3 could be rotated, which would change the orientation of everything in FIG. 20 (other than the end seal spring top 34) relative to the application surface, and yet the end seal spring top 34 would be able to rock back and forth as needed on the pivot 94 to come into full contact with the application surface at both its leading-edge end and at its trailing-edge end.

A screw 4 extends though a lug at the end of the end seal flexible spring 33 into the pivot point 94 of the end seal flexible spring top 34. The end seal flexible spring top 34 is thereby properly located and yet allowed to pivot freely around the screw 4, and is allowed to deflect in and out toward and away from the pressure feed application system bar center of rotation. The end seal flexible spring top 34 effectively seals the pressure feed application system cavity throughout the complete range of plunge depths and angles. The three curved seal lips, 111, 112, 113, closely match the contour of the application surface. This design of end seals with its ability to maintain proper orientation to the application surface only requires one seal lip 111. Optionally one or multiple seal lips may be used.

In order to insure that the point where the roll surface is exiting the end seal flexible spring top 34 is effectively sealed, a second spring 38, is used to apply pressure to the end of the end seal flexible spring top 34 at the end seal spring notch 95. The width and spacing of the seal lips 111, 112, 113 are selected based on the application surface characteristics. If the applicator roll ends tend to expand or fall away the spacing must be greater and cross-sections thinner to permit the end seal spring 38 to conform the outside portions of the end seal flexible spring top 34 to match the roll shape.

If the end seals were to have a fixed orientation, as in the prior art, then rotation of the pressure feed application system bar would lead to a reduced ability to seal the end of the nozzle cavity, as illustrated in FIGS. 24 to 29. If the end seals are not able to deflect to accept different plunge depths and different bar angles this technology cannot be effectively applied. The area identified as 114 shows an open area that will leak or spray coating outwards.

FIGS. 30 to 38 show different deflections and angle changes for end seals according to the invention, illustrating how the end seals permit sealing of the ends of the nozzle cavities, even with significant deflection of the nozzle and even when there is rotation of the pressure feed application system bar.

The FIGS. 24 to 29 are shown with the same center-to-center difference from the rigid frame 77 to the center of the application surface (here, applicator roll 6). In order to maintain the end seal in contact and concentric with the application surface the center-to-center distance of the rigid frame 77 and the application surface must be changed. In the cases shown the center-to-center distance must be decreased from the distance shown in FIG. 24 to a lesser distance that is clearly illustrated to be necessary in FIG. 26, and must further be decreased as is shown to be necessary in FIG. 28.

Deflection and angular impingement of the nozzle 55 to the application surface is important in the precise control of coating film thickness. In order to control coating film thickness from start-up to shut down the important process variables must be controlled. The force can be controlled in order to consistently set up the coater from start-up to start-up and works very well for the rigid nozzle. However, position is the preferred and most accurate method of controlling the flexible nozzle. In order to utilize position as the control method it is necessary to correct position for all angle changes of the rigid frame 77 and the end seal flexible spring top 34. The exact geometry of the equipment will determine the specific correction factors to nozzle position that must be used. This correction factor will either add or subtract to the direct position reading.

Figure 40:
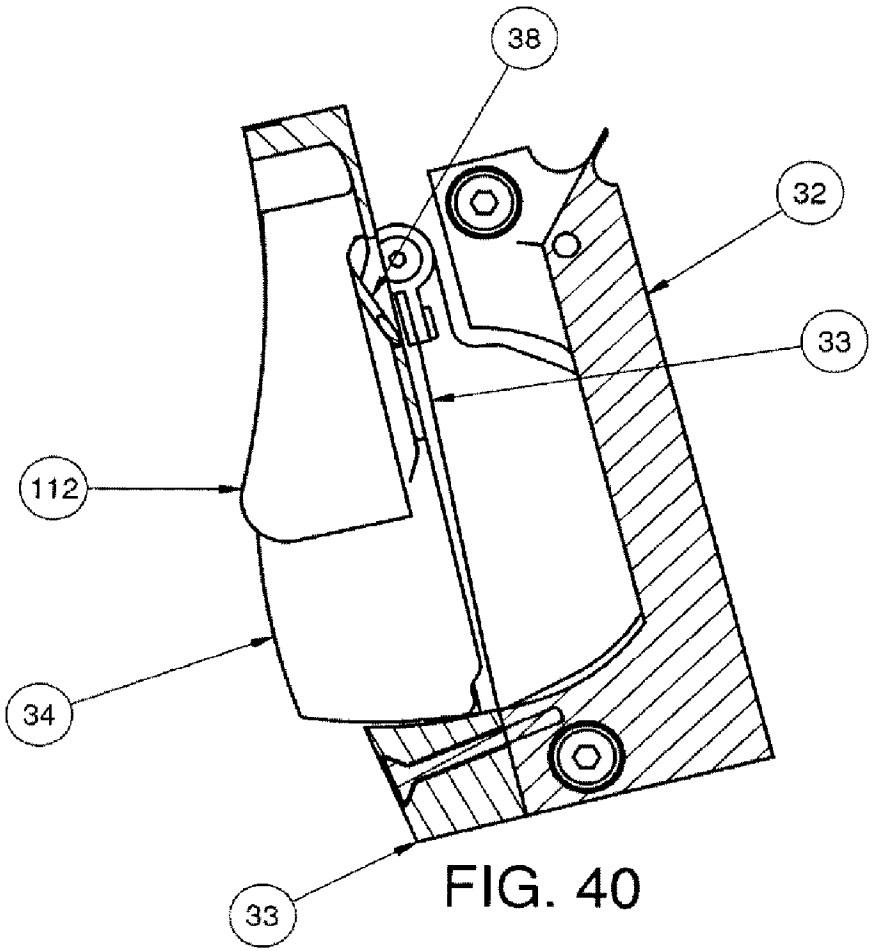
FIG. 40 is a broken-away view of an end seal from between seal lip 3 and seal lip 2 looking toward seal lip 2.
Figure 39:
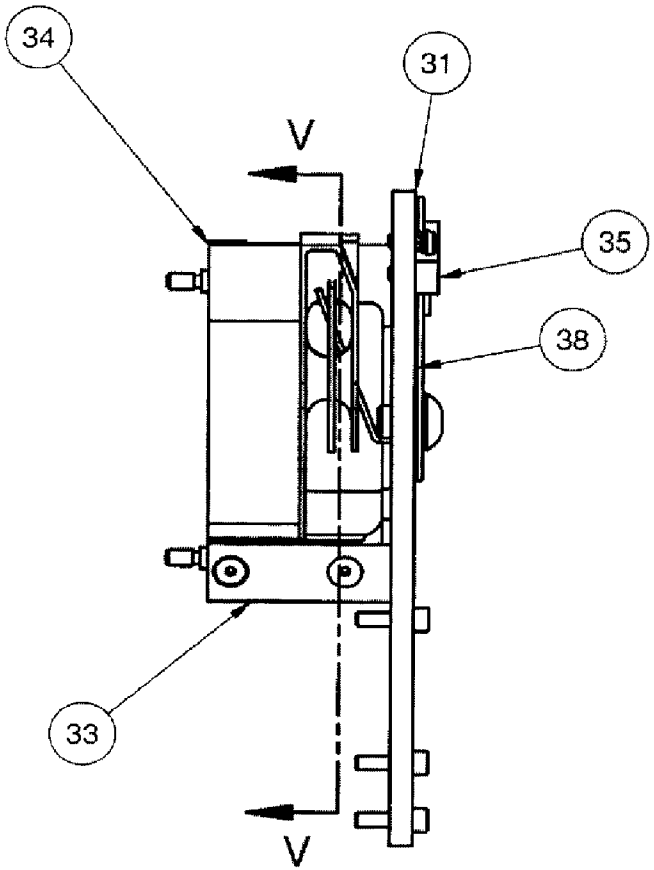
FIG. 39 is a top view of an end seal.

FIG. 40 shows the design of the seal lip 112. The design can use a single seal lip or multiple seal lips. This seal is designed to have approximately the same radius of curvature as the application surface. Preferably, however, it has a center of this radius that is offset from the centers of radius of the other seal lips. This positions the leading end of this seal lip 112 higher than the other seal lips. The lower portion of this seal lip where it attaches to the main body of the end seal is removed. Only a short section at the trailing edge is not removed and attaches this seal lip 12. This effectively seals radially further around the application surface than the fixed seal lips. The soft spring created with the undercut does not create wear or damage to the end seal, the seal lip, or the application surface.

The end seal flexible top air bleed 108 (FIGS. 20, 22, 25) provides a method for clearing any air in the nozzle. This opening can be fitted with a screw for regulating flow. This enables a thermal profile to be created across the width of the nozzle. Experience shows that as the coating rotates in the nozzle cavity, the turbulence builds heat, so that toward the outsides of the nozzle, the coating is less viscous and thus the wet film is applied thinner towards the outsides. Controlling the rate of excess flow controls the magnitude of the profile. The drain slot 109 permits coating material to be drained back to the return funnels 64 to recycle the coating.

The end seal spring guard 35 is used to protect the end seal spring 38 from damage and provides an ability to vary the force on the end of the end seal flexible spring top 34. The end seal flexible spring top 34 can be made of any material that has a low coefficient of friction with the application surface, that is resistant to degradation from the paints/coating and solvents used, and that has a low coefficient of adhesion to the coatings used. In many applications, Teflon (PTFE) or Delrin families of materials make a good choice.

The second end seal 130 design is shown in FIGS. 21, 22 and 23. This design is a simpler design as compared with the end seal design discussed above, but limits plunge depth to about 0.10" and limits rotation to approximately 2 degrees of rotation. This design is made up of the end seal base 102, the end seal flexible top 104, the end seal spring 38, the end seal spring guard 35, the end seal cover 31, and necessary fasteners. The end seal base 102 attaches to the nozzle holder 90 or the feed nozzle 38 from U.S. Pat. No. 6,656,529, depending on the configuration in use. Although the design and manufacturing may be more complicated, the components may be configured and manufactured differently to achieve the same effect. In the configuration shown the end seal flexible top 104 is bolted to the end seal base 102 through the end seal flexible top bolt holes 105.

The inside surface of the end seal flexible top 104 is undercut approximately 0.003", shown as area 106, to provide a clearance from the nozzle holder 90 or feed nozzle 38 from U.S. Pat. No. 6,656,529, for free rotational movement around the end seal flexible top flex point 107, while preventing excess coating leakage.

The end seal air bleed 108 provides a method for clearing any air in the nozzle. This opening can be fitted with a screw for regulating flow. This enables a thermal profile to be created across the width of the nozzle. As the coating rotates in the nozzle cavity, the turbulence builds heat, making the coating less viscous, and thus the wet film is applied thinner towards the outside of the nozzle. Controlling the rate of excess flow controls the magnitude of the thermal profile. The drain slot 109 permits coating material to be drained back to the return funnels 64 to recycle the coating.

The end seal spring guard 35 is used to protect the end seal spring 38 from damage and provides an ability to apply an adjustable force to the front of the end seal flexible spring top 104 at the end seal spring notch 107. The end seal flexible spring top 104 can be made of any material that has a low coefficient of friction with the application surface, that is resistant to degradation from the paints/coating and solvents used and that has a low coefficient of adhesion to the coatings used. In many applications, Teflon (PTFE) or Delrin families of materials make a good choice One way to describe the end seals is that each end seal has a front defining an outward direction (toward the top in FIG. 18 or FIG. 22), a leading edge defining a downward direction (toward the upper left in FIG. 18 or FIG. 22), and a trailing edge opposite the leading edge (toward the lower right in FIG. 18 or FIG. 22), the end seal comprising a first lip 111 (FIGS. 18 and 23), a second lip 112, and a third lip 113, each lip elongated and extending toward the leading edge and toward the trailing edge, each lip having a portion having a radius of curvature about a respective center; the second lip 112 disposed between the first lip 111 and the third lip 113; the center of radius of curvature of the second lip 112 offset from the center of radius of curvature of the first lip 111; and the center of radius of curvature of the second lip 112 offset from the center of radius of curvature of the third lip 113. The center of radius of curvature of the first lip 111 may be coaxial with the center of radius of curvature of the third lip 111. The first and third lips may join toward the trailing edge. A first spring means (member 93 in FIG. 20, or the springiness of member 104 in FIG. 23) urges the end seal outwards, that is, toward the application surface. An optional second spring means 38 urges the end seal outwards as well.

One way to describe the nozzle that results when the end seals according to the invention are employed is that it is an elongated nozzle having an elongated opening defined along its length by a flexible back seal 7 (FIG. 2*a*) and a metering surface 55 defined with respect to an upward direction of travel of a substrate or roll past the elongated opening, the substrate or roll having a width, the direction of travel such that the substrate or roll first encounters the flexible back seal 7 and later encounters the metering surface 55, the elongated opening having first and second ends separated by a distance, the distance less than the width of the substrate or roll 6; the nozzle defining a back direction away from the substrate or roll and a front direction toward the substrate or roll 6; a first end seal at the first end and a second end seal at the second end. The seals are as described above.

It will be appreciated that the nozzle is used to provide a coating fluid under a first pressure through the nozzle toward the substrate or roll 6. The shape of the end seal is chosen to give rise to a second pressure of the coating fluid within a pocket defined by the first and third lips of the seal, the second pressure less than the first pressure. A drip pan 30 (FIG. 2) is positioned below the first end seal and below the second end seal.

Those skilled in the art will have no difficulty devising myriad obvious improvements and variations upon the invention as described herein, all of which are intended to be encompassed within the scope of the claims that follow.

The invention claimed is:

1. An apparatus comprising:

an elongated nozzle having an elongated opening defined along its length by a flexible back seal and a metering surface defined with respect to an upward direction of travel of a substrate or roll past the elongated opening, the substrate or roll having a width, the direction of travel such that the substrate or roll first encounters the flexible back seal and later encounters the metering surface, the elongated opening having first and second ends separated by a distance, the distance less than the width of the substrate or roll; the nozzle defining a back direction away from the substrate or roll and a front direction toward the substrate or roll;

a first end seal at the first end;

a second end seal at the second end;

the first seal comprising first, second, and third lips each extending in the direction of travel and each having an edge in the direction of the substrate or roll;

the second seal comprising first, second, and third lips each extending in the direction of travel and each having an edge in the direction of the substrate or roll;

the first lips of the first and second seals disposed toward each other;

the third lips of the first and second seals disposed away from each other;

the second lip of the first seal disposed between the first and third lips of the first seal;

the second lip of the second seal disposed between the first and third lips of the second seal;

the first and third lips of the first seal joined together at top ends thereof;

the first and third lips of the second seal joined together at top ends thereof;

the edges of the first and third lips of the first and second seals shaped to fit the substrate or roll.

2. The apparatus of claim 1 wherein each lip has a portion having a radius of curvature about a respective center;

the center of radius of curvature of the second lip is offset from the center of radius of curvature of the first lip; and the center of radius of curvature of the second lip is offset from the center of radius of curvature of the third lip.

3. The end seal of claim 1 wherein each lip has a portion having a radius of curvature about a respective center; and wherein the center of radius of curvature of the first lip is coaxial with the center of radius of curvature of the third lip.

4. The apparatus of claim 1 wherein:

the first end seal is mounted to the nozzle by means of a flexible bracket; and the second end seal is mounted to the nozzle by means of a flexible bracket.

5. The apparatus of claim 1 further comprising coating fluid under a first pressure through the nozzle toward the substrate or roll;

the shape of the first end seal chosen to give rise to a second pressure of the coating fluid within a pocket defined by the first and third lips of the first seal, the second pressure less than the first pressure;

the shape of the second end seal chosen to give rise to a third pressure of the coating fluid within a pocket defined by the first and third lips of the second seal, the third pressure less than the first pressure.

6. The apparatus of claim 1 further comprising a drip pan positioned below the first end seal and below the second end seal.

7. An apparatus comprising:

an elongated nozzle having an elongated opening defined along its length by a flexible back seal and a metering surface defined with respect to an upward direction of travel of a substrate or roll past the elongated opening, the substrate or roll having a width, the direction of travel such that the substrate or roll first encounters the flexible back seal and later encounters the metering surface, the elongated opening having first and second ends separated by a distance, the distance less than the width of the substrate or roll; the nozzle defining a back direction away from the substrate or roll and a front direction toward the substrate or roll;

a first end seal at the first end;

a second end seal at the second end;

the first seal comprising first, second, and third lips each extending in the direction of travel and each having an edge in the direction of the substrate or roll;

the second seal comprising first, second, and third lips each extending in the direction of travel and each having an edge in the direction of the substrate or roll;

the first lips of the first and second seals disposed toward each other;

the third lips of the first and second seals disposed away from each other;

the first and third lips of the first seal joined together at top ends thereof;

the first and third lips of the second seal joined together at top ends thereof;

the second lip of the first seal disposed between the first and third lips thereof;

the second lip of the second seal disposed between the first and third lips thereof;

the edges of the first and third lips of the first and second seals shaped to fit the substrate or roll;

the first end seal mounted to the nozzle by means of a flexible bracket; and the second end seal mounted to the nozzle by means of a flexible bracket.

8. The apparatus of claim 7 further comprising a drip pan positioned below the first end seal and below the second end seal.

9. The apparatus of claim 7 wherein each lip has a portion having a radius of curvature about a respective center;

the center of radius of curvature of the second lip is offset from the center of radius of curvature of the first lip; and the center of radius of curvature of the second lip is offset from the center of radius of curvature of the third lip.

10. The apparatus of claim 7 wherein each lip has a portion having a radius of curvature about a respective center; and wherein the center of radius of curvature of the first lip is coaxial with the center of radius of curvature of the third lip.

11. Apparatus comprising a first nozzle and a return funnel, the apparatus positioning the first nozzle and the return funnel relative to an applicator roll or web, the first nozzle comprising a slot elongated along a first axis, the slot defined by a flexible back seal elongated along the first axis and by a metering surface elongated along the first axis, the back seal and metering surface defining a first plane parallel with the first axis;

the slot disposed in osculation with the applicator roll or web along a line;

the apparatus comprising means by which the first nozzle may be fixed at any of a plurality of orientations so that the first plane is at any of a plurality of respective angles of rotation about the first axis;

wherein the apparatus comprises means causing the return funnel to follow the respective angle of rotation about the first axis.

12. An apparatus comprising:

an elongated nozzle having an elongated opening defined along its length by a flexible back seal and a metering surface defined with respect to an upward direction of travel of a substrate or roll past the elongated opening, the substrate or roll having a width, the direction of travel such that the substrate or roll first encounters the flexible back seal and later encounters the metering surface, the elongated opening having first and second ends separated by a distance, the distance less than the width of the substrate or roll; the nozzle defining a back direction away from the substrate or roll and a front direction toward the substrate or roll;

a first end seal at the first end;

a second end seal at the second end;

the first seal comprising a first lip extending in the direction of travel having an edge in the direction of the substrate or roll and having a first end toward the back seal and a second end toward the metering surface;

the second seal comprising a first lip extending in the direction of travel having an edge in the direction of the substrate or roll and having a first end toward the back seal and a second end toward the metering surface;

the edge of the first lip of the first and second seals shaped to fit the substrate or roll;

the first end seal pivotable about a first pivot point between first end and the second end thereof;

the second end seal pivotable about a second pivot point between first end and the second end thereof;

the first pivot point and the second pivot point each biased in the front direction.

13. The apparatus of claim 12 further comprising a drip pan positioned below the first end seal and below the second end seal.

14. The apparatus of claim 12 further comprising a first spring urging the second end of the first lip in the front direction, and a second spring urging the second end of the second lip in the front direction.

15. The apparatus of claim 12 wherein the nozzle is rotatable about an axis parallel to the elongated opening, the apparatus comprising means by which the nozzle may be fixed at any of a plurality of respective angles of rotation about the first axis.

16. An apparatus comprising:

one or more elongated nozzles consisting of a leading edge, a metering surface and end seals having an elongated opening that deposits coating to an application surface;

a return trough for the one or more elongated nozzles to collect undeposited coating back for recycling;

a return funnel for collecting undeposited coating from the return trough for return to a coating tank for recycling; and a system for opening the return funnel away from the nozzles and return trough to permit clearance for rotation of the nozzle or nozzles for cleaning.

17. An apparatus comprising:

one or more elongated nozzles consisting of a leading edge, a metering surface and end seals having an elongated opening that deposits coating to an application surface;

a return trough for the one or more elongated nozzles to collect undeposited coating back for recycling;

a return funnel for collecting undeposited coating from the return trough for return to a coating tank for recycling; and a system for holding the return funnel into proper production orientation while the return funnel is open and the nozzles are being rotated for cleaning.

* * * * *